US005440639A

United States Patent [19]

Suzuki et al.

[11] Patent Number: 5,440,639

[45] Date of Patent: Aug. 8, 1995

[54] SOUND LOCALIZATION CONTROL APPARATUS

[75] Inventors: Yasutake Suzuki; Junichi Fujimori, both of Hamamatsu, Japan

[73] Assignee: Yamaha Corporation, Hamamatsu, Japan

[21] Appl. No.: 135,900

[22] Filed: Oct. 13, 1993

[30] Foreign Application Priority Data

Oct. 14, 1992 [JP] Japan ..... 4-276375
Nov. 26, 1992 [JP] Japan ..... 4-317524

[51] Int. Cl.[6] ..... H04S 5/00
[52] U.S. Cl. ..... 381/17; 381/63
[58] Field of Search ..... 381/17, 63, 1

[56] References Cited

U.S. PATENT DOCUMENTS 4,118,599 10/1978 Iwahara et al. .
4,188,504 2/1980 Kasuga et al. .
4,192,969 3/1980 Iwahara .
4,219,696 8/1980 Kogure et al. .
4,817,149 3/1989 Myers .
4,980,914 12/1990 Kunugi et al. .
5,046,097 9/1991 Lowe et al. .
5,105,462 4/1992 Lowe et al. .
5,173,944 12/1992 Begault ..... 381/17
5,305,386 4/1994 Yamato ..... 381/17

*Primary Examiner*—Forester W. Isen

*Attorney, Agent, or Firm*—Spensley Horn Jubas & Lubitz

[57] ABSTRACT

A sound localization control apparatus is used to localize the sounds, which can be produced from a synthesizer and the like, at a target sound-image location. The target sound-image location is intentionally located in a three-dimensional space which is formed around a listener who listens to the sounds. The sound localization control apparatus at least provides a controller, a plurality of sound-directing devices and an allocating unit. The controller produces a distance parameter and a direction parameter with respect to the target sound-image location. The allocating unit allocates acoustic data (e.g., two-channel binaural signals), representing the sounds to be localized, to the sound-directing devices in response to the distance parameter and the direction parameter. Each of the sound-directing devices is applied with each of predetermined sounding directions which are arranged in a horizontal plane with respect to the listener. Thus, each sound-directing device performs a data processing on the acoustic data allocated thereto so as to eventually localize the sounds in each of the predetermined sounding direction. At least three sounding directions are required when localizing the sounds. The sound-directing device can be configured by a finite-impulse response filter.

22 Claims, 15 Drawing Sheets

SOUND LOCALIZATION CONTROL APPARATUS

BACKGROUND OF THE INVENTION

The present invention relates to a sound localization control apparatus which controls a sound-image location in a sound field in which several kinds of artificial sounds are sounded.

Conventionally, several kinds of sound localization methods are proposed in order to obtain a desired sound-field effect which simulates a sound-field effect of a theater or an auditorium. FIG. 1 shows one of measuring methods by which the sound-field effect of the theater to be simulated is experimentally measured by use of a dummy head DH. On the basis of results of the measurements, sounding data are processed so as to obtain a sound localization effect which is similar to that of the real theater. The dummy head DH shown in FIG. 1 has a predetermined shape which is similar to the shape of a human head. At positions where right and left ears are located in the human head, microphones MR and ML are respectively attached to the dummy head DH.

In FIG. 1, a location of a sound source can be defined by a horizontal angle $\phi$, a vertical angle $\theta$ and a distance D (which is fixed at 1 m, for example). The dummy head DH detects the sounds produced from the above sound source in form of the waveforms which are transmitted to the left and right ears, thus measuring a difference between the waveform detected and an original waveform representing the sound produced from the sound source. Such measurement is carried out with respect to the sounds to be respectively produced from the sound sources which are respectively arranged in a virtual space as shown in FIG. 1. On the basis of data representing the results of the measurements, a so-called head-related transfer function is computed with respect to each of the locations of the sound sources. Herein, the head-related transfer function is used to convert the waveform of the sound produced from the sound source into another waveform corresponding to the sound which is transmitted to the right ear or left ear of the dummy head DH.

Next, an electronic configuration of a finite-impulse response filter (i.e., FIR filter) is determined responsive to the head-related transfer function computed. Then, acoustic data corresponding to the sound produced is applied to the FIR filter corresponding to a desired sound-image localization (hereinafter, referred to as a target sound-image location). In the FIR filter, the acoustic data is processed and is subjected to digital filtering. When hearing the sound which is created from the output of the FIR filter, a person (i.e., listener) who listens to the sound produced may feel as if the sound is actually produced from the target sound-image location.

When configuring the FIR filter corresponding to the head-related transfer function, it is possible to compute the head-related transfer function as described above. Or, an impulse (or tone burst) is produced from the sound source, and then, an amplitude of its impulse-response waveform is used as a coefficient, by which the FIR filter is configured.

According to an example of the sound localization control apparatus which employs the aforementioned method of measuring the sounding effects, a mixing ratio of reverberation sounds is controlled so as to simply control the sound-image localization.

FIG. 2 is a block diagram showing a diagrammatical configuration of an example of the sound localization control apparatus. In FIG. 2, a numeral 1 designates an input terminal to which the acoustic data is applied; and numerals *2a* and *2b* designate multipliers to which the acoustic data is supplied through the input-terminal 1. The multipliers *2a* and *2b* function to divide the acoustic data by use of multiplication coefficients *2ak* and *2bk* which are supplied from a control portion (not shown). These multiplication coefficients *2ak* and *2bk* are determined such that a sum of them becomes equal to "1". Thus, a part of the acoustic data is outputted from the multiplier *2a* and is supplied to multipliers M1 to M12, while another part of the acoustic data is outputted from the multiplier *2b* and is supplied to a reverberation circuit RV.

Incidentally, a mixing ratio by which the acoustic data is mixed with reverberation data is set small when the target sound-image location is relatively close to the listener, while it is set large when the target sound-image location is relatively far from the listener.

The reverberation circuit RV forms the reverberation data on the basis of the acoustic data which is supplied thereto through the multiplier *2b*. The reverberation data is divided into two components, i.e., a right-channel component and a left-channel component. The right-channel component of the reverberation data is supplied to an adder 3R, while the left-channel component of the reverberation data is supplied to an adder 3L. On the basis of multiplication coefficients C1 to C12 given from the aforementioned control portion, the multipliers M1 to M12 respectively carry out multiplications on the acoustic data which is outputted from the multiplier *2a*.

Symbols "dir1" to "dir12" designate sound-directing devices, which respectively perform convolution operations based on the head-related transfer function on the output data of the multipliers M1 to M12. Thus, each of the sound-directing devices eventually produces a right-channel component and a left-channel component with respect to the acoustic data. Then, the right-channel component of the acoustic data is supplied to the adder 3R, while the left-channel component of the acoustic data is supplied to the adder 3L. Each of the sound-directing devices is configured as shown in FIG. 3, in which two FIR filters are connected in parallel. Herein, the FIR filter can be embodied by a LSI circuit exclusively used for performing the convolution operation or a digital signal processor (i.e., DSP), while a coefficient ROM storing coefficients which are used for the convolution operation is externally provided.

In order to simplify the description, each of the sound-directing devices dir1 to dir12 is configured with respect to the horizontal direction only. For example, the sound-directing device dir1 corresponds to a front direction of the listener, in other words, the horizontal angle of the sound-directing device dir1 is set at 0°, while the sound-directing device dir2 corresponds to a certain right-side direction which deviates from the front direction of the listener by 30°, in other words, the horizontal angle of the sound-directing device dir2 is set at 30°. Similarly, the horizontal angles of the adjacent sound-directing devices are deviated from each other by 30°; therefore, the last sound-directing device dir12 corresponds to a certain left-side direction which deviates from the front direction of the listener by 30°, in other words, the horizontal angle of the sound-directing device dir12 is set at 330°. Each of the sound-directing devices performs the convolution operation based on the head-related transfer function corresponding to the sound source whose sound-image location corresponds to the horizontal angle thereof.

Now, the acoustic data whose sound-image location must be fixed at the location defined by the horizontal angle 30° is applied to the input terminal 1, through which the acoustic data is supplied to the multipliers *2a* and *2b*. The multipliers *2a* and *2b* receive the multiplication coefficients *2ak* and *2bk* respectively, which correspond to the distance between the listener and the target sound-image location. By use of the multiplication coefficients *2ak* and *2bk*, the multipliers *2a* and *2b* respectively perform the multiplications on the acoustic data. The results of the multiplications are delivered to the multipliers M1 to M12 and the reverberation circuits RV as described before. In this case, a direction in which the sound corresponding to the acoustic data is to be localized (hereinafter, simply referred to as a target sound-image direction) corresponds to the horizontal angle 30°. Thus, the aforementioned control portion automatically selects the sound-directing device dir2 performing the convolution operation based on the head-related transfer function corresponding to the sound source which is located in a direction of horizontal angle 30°. In other words, only the multiplication coefficient C2 which is supplied to the multiplier M2 is set at "1", while the other multiplication coefficients for the multipliers M1 and M3 to M12 are all set at "0".

In the sound-directing device dir2 to which the acoustic data outputted from the multiplier M2 is only supplied, the convolution operation is performed on the acoustic data so as to produce the right-channel component and left-channel component for the acoustic data, which are respectively supplied to the adders 3R and 3L.

Meanwhile, the output data of the multiplier *2b* is converted into the reverberation data by the reverberation circuit RV, so that the right-channel component and left-channel component for the reverberation data are respectively supplied to the adders 3R and 3L.

Thereafter, a sum of the acoustic data outputted from the sound-directing device dir2 and the reverberation data outputted from the reverberation circuit RV is outputted from the sound localization control apparatus shown in FIG. 8.

In the meantime, when locating the sound image in a direction of horizontal angle 45°, the multiplication coefficients C2 and C3 for the multipliers M2 and M3 are set at the same value, while the other multiplication coefficients for the multipliers M1 and M4 to M12 are all set at "0". Since the multipliers M2 and M3 are only activated, the sound-directing devices dir2 and dir3 which correspond to the horizontal angles 30° and 60° respectively are only activated.

More specifically, the acoustic data is supplied to the multiplier *2a* in which the multiplication using the multiplication coefficient *2ak* is performed, and then, the output data of the multiplier *2a* is delivered to the multipliers M1 to M12. In this case, however, only the sound-directing devices dir2 and dir3 receive the acoustic data through the multipliers M2 and M3 which are activated, while the other sound-directing devices do not receive the acoustic data. In the sound-directing device dir2, the convolution operation is performed on the acoustic data on the basis of the head-related transfer function corresponding to the sound source which is located in a direction of horizontal angle 30°. In another sound-directing device dir3, another convolution operation is performed on the acoustic data on the basis of another head-related transfer function corresponding to another sound source which is located in a direction of horizontal angle 60°. Then, the right-channel components for the acoustic data respectively outputted from the sound-directing devices dir2 and dir3 are supplied to the adder 3R, while the left-channel components for the acoustic data respectively outputted from the sound-directing devices dir2 and dir3 are supplied to the adder 3L.

On the other hand, the multiplier *2b* performs the multiplication using the multiplication coefficient *2bk* on the acoustic data, so that the output data of the multiplier *2b* is supplied to the reverberation circuit RV. In the reverberation circuit RV, the right-channel component and left-channel component for the reverberation data are computed, and then, they are respectively supplied to the adders 3R and 3L.

In the adders 3R and 3L, the acoustic data outputted from the sound-directing devices dir2 and dir3 are added with the reverberation data outputted from the reverberation circuit RV; and finally, two-channel data corresponding to the original acoustic data are obtained.

In the sound localization control apparatus described above, a distance between the listener and the sounding point (i.e., sound source) is controlled by the mixing ratio with respect to the reverberation sounds. Therefore, it may be possible to obtain a weak impression by which the listener may feel as if the size of the room is changed in response to the above mixing ratio. However, the distance between the listener and the sound source cannot be controlled well so that the sound-image location cannot be fixed well.

The above-mentioned drawback may be eliminated by changing the aforementioned distance D (which has been previously fixed at 1 m) and re-designing the electronic configuration of the apparatus such that the sound-directing devices are further provided with respect to the predetermined distances as well as the predetermined directions. In such case, however, a large number of the sound-directing devices should be required, resulting that a system size of the apparatus must become extremely large.

According to the results of the experiments which are carried out with respect to sampling frequencies ranging from 40 kHz to 50 kHz, when embodying the head-related transfer function with respect to each of the distances as well as each of the directions, the FIR filter must be configured by hundreds of operational circuits (more specifically, thousands of operational circuits), and such large-scale FIR filter should be provided for each of the right channel and left channel.

And, it is also required that the sound localization control apparatus utilizing the above-mentioned large-scale FIR filter should cover the space having a semi-spherical shape as shown in FIG. 1, the radius of which is set at 10 m, for example. In this case, the apparatus should control the sound-image localization with respect to twelve directions (i.e., every 30-degree direction in 360°) as well as one-hundred distance stages (i.e., every 100 mm distance in 10 m). In order to do so, the apparatus should have an operating capacity by which the multiplications and additions can be performed by one-hundred and twenty million times per one second, wherein such number of "one-hundred and twenty million" is calculated as follows: 2 (representing a number of the FIR filters to be required)×12 (representing a number of the directions)×100 (representing a number of the distance stages)×50000 (Hz).

As the method which controls the sound-image location to be moved arbitrarily by use of the sound-directing devices, there are provided two methods, i.e., a coefficient time-varying method and a virtual speaker method, for example. FIG. 4 is a block diagram showing an example of the sound localization control apparatus employing the coefficient time-varying method. In FIG. 4, acoustic data S1 (e.g., digital data representing the sounds of the car running) is supplied to a time-varying sound-directing portion $\mathbf{1S_1}$ and is divided into the left-channel component and right-channel component, which are respectively supplied to sound-directing devices 2L and 2R.

A control portion 3 outputs a pair of the coefficients, corresponding to the target sound-image location, which are respectively supplied to the sound-directing devices 2L and 2R. Thus, the acoustic data S1 is subjected to signal processing corresponding to the convolution operation using a pair of coefficients. Then, the right-channel component and left-channel component for the acoustic data S1 are respectively produced. Incidentally, a pair of the coefficients to be respectively supplied to the sound-directing devices 2L and 2R is read from a coefficient memory 4 in response to the target sound-image location by the control portion 3.

If there exists any other acoustic data (e.g., digital data representing the musical sounds produced from the musical instrument such as the trumpet) the sound image of which is to be localized, another time-varying sound-directing portion can be provided, in other words, a plurality of time-varying sound-directing portions can be provided in the apparatus. If another acoustic data S2 is supplied to another time-varying sound-directing portion $\mathbf{1S_2}$, it is subjected to the signal processing as described above. Thereafter, the left-channel component of the acoustic data S1 and the left-channel component of the acoustic data S2 are added together by an adder 5L, while the right-channel component of the acoustic data S1 and the right-channel component of the acoustic data S2 are added together by an adder 5R. Thus, added data for the left channel is obtained from a terminal "L", while another added data for the right channel is obtained from a terminal "R".

Under the operation of the above-mentioned apparatus, it may be possible to smoothly move the target sound-image location with respect to the acoustic data S1 so that the listener may feel as if the car is running away. In this case, however, every time the target sound-image location is changed, the control portion 3 should read out a pair of coefficients, corresponding to the target sound-image location changed, from the coefficient memory 4 so as to supply the coefficients to the sound-directing devices 2L and 2R respectively. In such case, there is a possibility in that noises may be occurred at each time when the coefficients to be read from the coefficient memory 4 are changed. In order to avoid an occurrence of noises, the coefficient memory 4 should store plenty of coefficients, each pair of which corresponds to each of the locations which are arranged to cover the predetermined space as a whole. If a number of the coefficients, each pair of which corresponds to each of the sound-image locations actually measured in the predetermined space, is limited, it is necessary to perform an interpolation operation on plural pairs of the coefficients when computing a pair of coefficients corresponding to the sound-image location which is not actually measured. Incidentally, the control portion 3 is designed to change a pair of coefficients at each sampling period.

The above-mentioned coefficient time-varying method accurately works in accordance with a principle of the sound localization. Thus, it is expected that the sound image obtained is accurately and clearly localized at the target sound-image location. However, in order to obtain an ability to sufficiently control the sound localization, hundreds of or thousands of coefficients must be required for the sound-directing devices 2L and 2R respectively. In other words, it is necessary to provide a super-high-speed processor which can change over the hundreds of or thousands of coefficients while performing the interpolation operations at each sampling period (e.g., 20 μs if the sampling frequency is 50 kHz). Further, the above super-high-speed processor must be provided for each of the sounds whose sound images are respectively localized at different locations. Since such super-high-speed processor is relatively expensive, the system cost required for the apparatus becomes extremely high. For this reason, the apparatus employing the coefficient time-varying method has not been manufactured.

Different from the above-mentioned coefficient time-varying method, the virtual speaker method does not vary the coefficients in real time so that the virtual speaker method uses the fixed coefficients, whereas this method requires a plenty of sound-directing devices. Each of the sound-directing devices corresponds to each of the locations which are tightly arranged in the predetermined space. Thus, instead of varying a plenty of coefficients in each sampling period, the virtual speaker method switches over the sound-directing device to which the acoustic data is supplied.

FIG. 5 is a block diagram showing an example of the sound localization control apparatus employing the virtual speaker method. Herein, twelve locations are determined in advance so that twelve pairs of the sound-directing devices (i.e., $\mathbf{9L_1}$, $\mathbf{9R_1}$, . . . , $\mathbf{9L_{12}}$, $\mathbf{9R_{12}}$). The acoustic data (S1, S2, . . . ) are supplied to the sound-directing devices in which they are subjected to signal processing corresponding to the convolution operation using a selected pair of the coefficients, so that two-channel data are eventually produced. When hearing the sounds corresponding to the two-channel data, the listener may feel as if the sounds are actually produced from a speaker which is located at a desired location corresponding to the selected pair of the coefficients. This speaker is called a virtual speaker which is not actually existed but from which the sounds are virtually produced.

When using two virtual speakers, the acoustic data can be allocated to the virtual speakers respectively by a predetermined ratio so that the sound-image location can be fixed at a desired point which exists between two virtual speakers. If the same amount of the acoustic data is allocated to each of the virtual speakers, the sound-image location can be fixed at a mid-point between two virtual speakers. Under the consideration of the above operating principle, by changing an allocation ratio by which the acoustic data is allocated to the virtual speakers respectively, it is possible to smoothly move the sound-image location between the virtual speakers.

FIG. 5 is a block diagram showing an example of the sound localization control apparatus employing the virtual speaker method. In FIG. 5, an allocating unit 6S1 contains multipliers 7L1 to 7L12 and 7R1 to 7R12, each of which performs a weighed multiplication when allocating a series of acoustic data represented as acoustic data S1. Another allocating unit 6S2 has a similar configuration of the allocating unit 6S1, so that each multiplier performs a weighted multiplication when allocating another series of acoustic data represented as acoustic data S2. Then, each of the pieces of the acoustic data S1 outputted from the allocating unit 6S1 is added with the corresponding one of the pieces of the acoustic data S2 outputted from the allocating unit 6S2 by each of adders 8L1 to 8L12 and 8R1 to 8R12 which are respectively coupled with sound-directing devices 9L1 to 9L12 and 9R1 to 9R12. Each of the sound-directing devices 9L1 to 9L12 and 9R1 to 9R12 performs a convolution operation corresponding to a location of its virtual speaker. Thus, the sound-directing devices 9L1 to 9L12 eventually output left-channel components for the acoustic data S1 and S2 mixed together, while the sound-directing devices 9R1 to 9R12 eventually output right-channel components for the acoustic data S1 and S1 mixed together. Finally, those left-channel components are added together by an adder 10L, while the right-channel components are added together by an adder 10R. As a result, two-channel data are eventually outputted from the adders 10L and 10R.

However, even when performing the virtual speaker method, it is not possible to clearly fix the sound-image location at the desired location. Because, the virtual speaker method basically functions to merely adjust an tone-volume balance between the virtual speakers when determining the sound-image location. Although a delay-time difference between the right-channel sound and left-channel sound should be adjusted in connection with the target sound-image location, the virtual speaker method merely adjusts such delay-time difference between the adjacent virtual speakers. Therefore, in order to obtain a clear sound-image localization fixed between the virtual speakers, it is necessary to reduce the delay-time difference between two virtual speakers which are arranged closely adjacent to each other such that the delay-time difference may be negligible.

In order to do so, however, it is necessary to provide an extremely large number of sound-directing devices, which eventually raise up the system cost for the apparatus. In the virtual speaker method, even if the number of the sounds to be localized (i.e., the number of the acoustic data applied) is increased, the sound localization control can be simply performed by merely increasing the number of the allocating units without increasing the number of the sound-directing devices. Thus, the virtual speaker method is advantageous in that the system cost may not be increased so much when increasing the number of the sounds to be localized.

As described before, the coefficient time-varying method is not realistic because the super-high-speed processors are required so that the system cost must be extremely increased.

Moreover, the virtual speaker method is not realistic because so many number of the sound-directing devices (e.g., hundreds of or thousands of sound-directing devices) are required in order to obtain a clear sound localization. If the number of the virtual speakers are reduced so that the density of the virtual speakers provided in the predetermined space is reduced, it is not possible to clearly put the sound-image location at a desired location between the virtual speakers.

SUMMARY OF THE INVENTION

Accordingly, it is an object of the present invention to provide a sound localization control apparatus which can clearly control the sound localization effect with a relatively small system configuration and without raising the system cost.

A sound localization control apparatus as defined by the present invention at least comprises a plurality of sound-directing devices, a controller and an allocating unit.

Each of the sound-directing devices has a function to localize the sounds corresponding to acoustic data applied thereto in each of predetermined sounding directions. The controller produces a direction parameter and a distance parameter in connection with a target sound-image location at which the sounds are localized. Herein, the direction parameter designates a direction from a listener who listens to the sounds to the target sound-image location, while the distance parameter designates a distance between the listener and the target sound-image location. The allocating unit selects at least one of sound-directing devices in response to the direction designated by the controller, so that the allocating unit allocates the acoustic data to the sound-directing device selected, while the allocating unit also allocates the acoustic data to one or some of the sound-directing devices, other than the sound-directing device selected, in response to the distance designated by the controller.

Thus, outputs of the sound-directing means are mixed together so as to reproduce the sounds corresponding to the acoustic data which are localized in accordance with the target sound-image location.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

[A] First Embodiment

Figure 6:
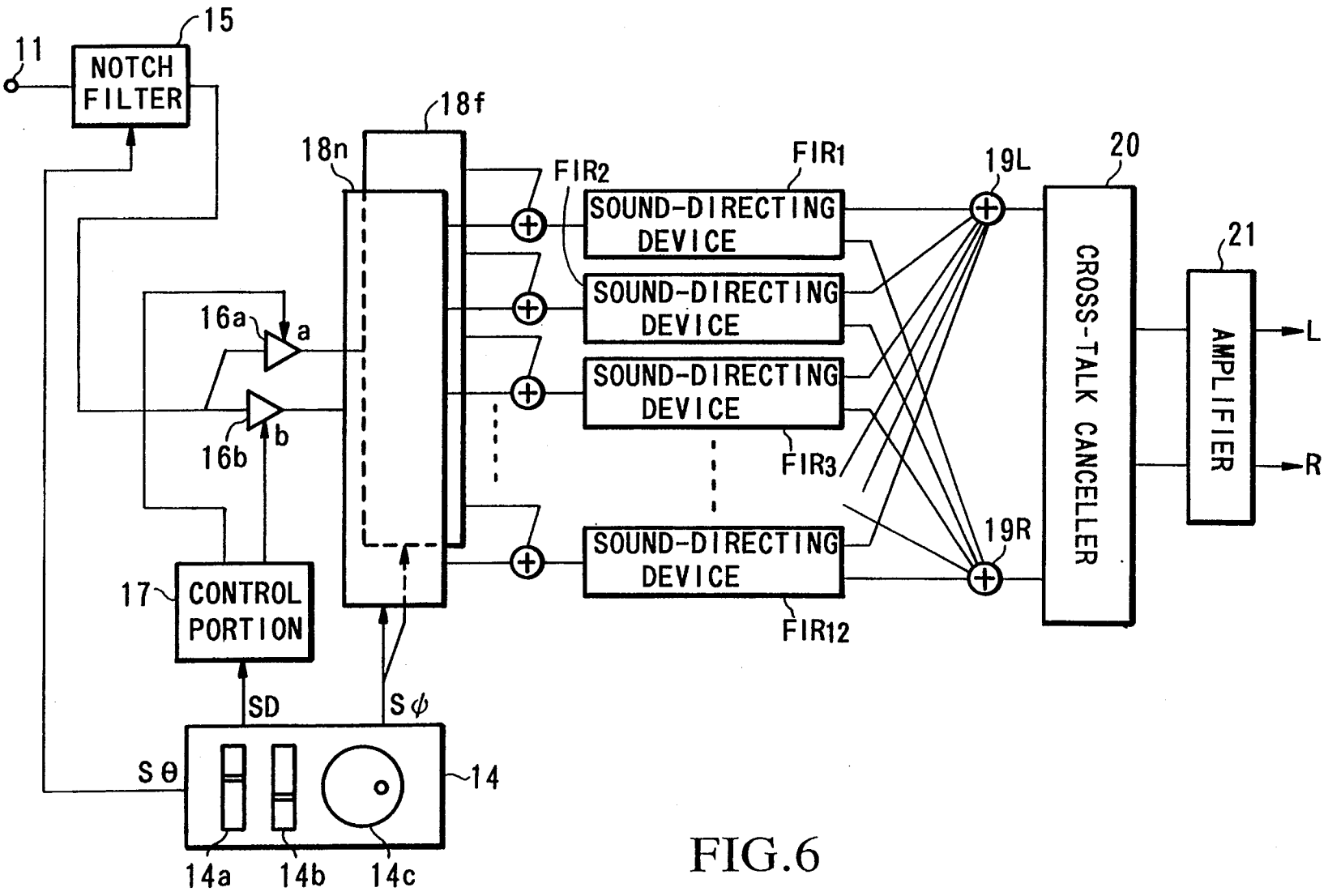
FIG. 6 is a block diagram showing an electronic configuration of the sound localization control apparatus according to a first embodiment of the present invention.

FIG. 6 is a block diagram showing an electronic configuration of a sound localization control apparatus according to a first embodiment of the present invention. In FIG. 6, a numeral 14 designates a sound localization controller which determines the target sound-image locations for the sounds. This sound localization controller 14 provides two slide switches **14*a*, 14*b* and one dial control 14*c*. Herein, an actuator (i.e., knob) of the slide switch 14*a* is slid to set the vertical angle $\theta$ for the target sound-image location; an actuator of the slide switch 14*b* is slid to set the distance D for the target sound-image location; and a rotary portion of the dial control 14*c*** is rotated to set the horizontal angle $\phi$ (ranging from 0° to 360°) for the target sound-image location.

In the sound localization controller 14, the vertical angle $\theta$, distance D and horizontal angle $\phi$ are respectively translated into vertical angle data $S\theta$, distance data SD and horizontal angle data $S\phi$.

A numeral 15 designates a notch filter which receives acoustic data through an input terminal 11 from an electronic device or a sound source of a video game device, for example. In response to the vertical angle data $S\theta$ given from the sound localization controller 14, the notch filter 15 performs a frequency-band-eliminating process on the acoustic data so as to output processed acoustic data, the sound image of which is localized in a direction of the vertical angle $\theta$.

By use of the notch filter, it is possible to control the sound localization in a vertical-angle direction. The details are described in some articles such as an article entitled "Psychoacoustical aspects of synthesized vertial locale cues" written by Anthony J. Watkins in J. Acoust. Soc. Am. 63(4), Apr. 1978. Therefore, the detailed explanation for the operations of the notch filter is omitted.

Numerals **16*a* and 16*b* designate multipliers which respectively perform multiplications on the output data of the notch filter 15 by use of multiplication coefficients "a" and "b". Those multiplication coefficients "a" and "b" are given from a control portion 17**.

Figure 7:
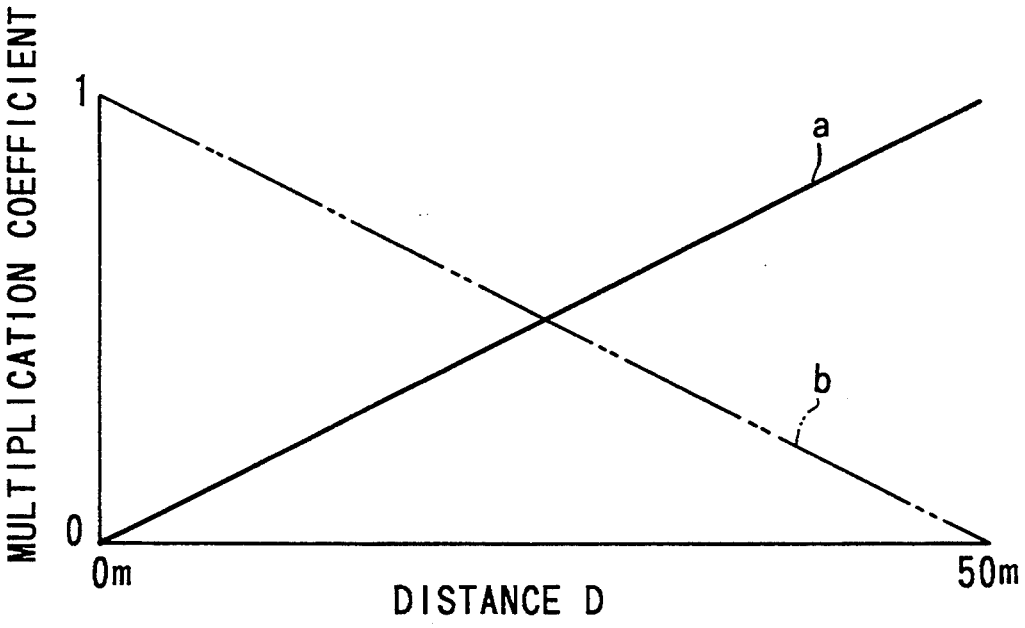
FIG. 7 is a graph showing a relationship between a distance and each of multiplication coefficients used for multipliers shown in FIG. 6.

The control portion 17 determines the multiplication coefficients "a" and "b" so as to supply them to the multipliers **16*a* and 16*b* respectively. Those multiplication coefficients "a" and "b" are controlled in response to the distance data D given from the sound localization controller 14 as shown in FIG. 7. More specifically, the multiplication coefficient "a" supplied to the multiplier 16*a*** is increased larger as the distance D becomes larger, while the multiplication coefficient "b" is decreased smaller as the distance D becomes larger.

Figure 8:
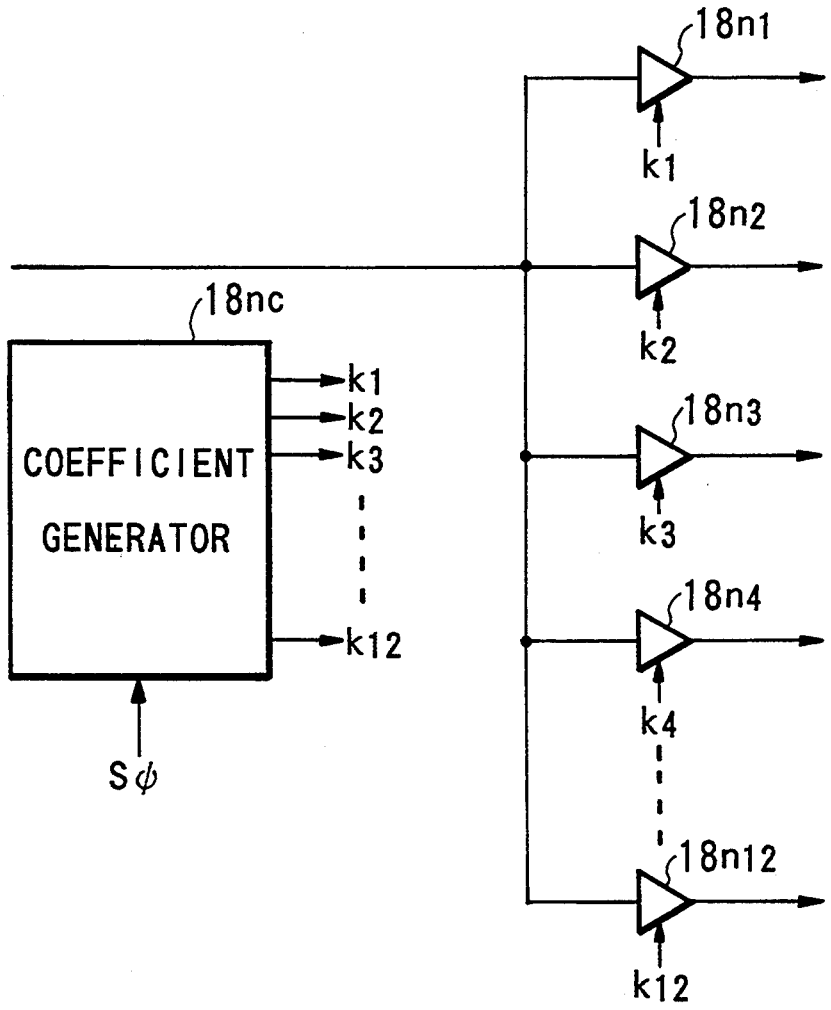
FIG. 8 is a block diagram showing a detailed configuration of an allocating unit for short distance shown in FIG. 6.
Figure 9:
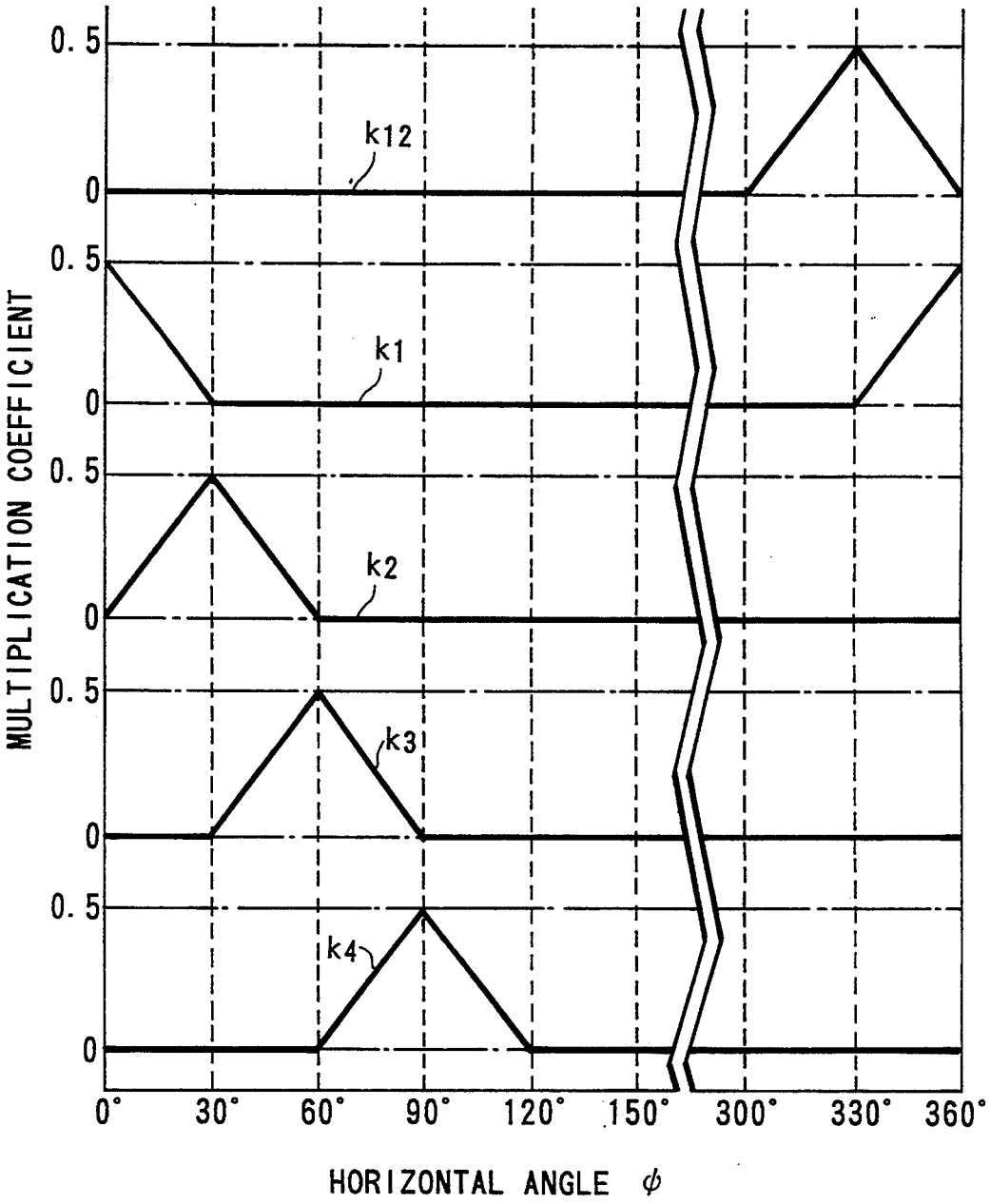
FIG. 9 is a graph showing a relationship between a horizontal angle and each of multiplication coefficients used for multipliers shown in FIG. 8.

A numeral **18*n* designates an allocating unit for short distance. This allocating unit 18*n* provides one input and twelve outputs. When receiving the output data of the multiplier 16*b* (representing the acoustic data processed), the allocating unit 18*n* allocates the data to one of or some of twelve destinations. FIG. 8 shows a detailed configuration of the allocating unit 18*n*. In response to the horizontal angle $\phi$, a coefficient generator 18*nc* generates multiplication coefficients $k_1$ to $k_{12}$ so as to supply them to multipliers 18*n*1 to 18*n*12 respectively. A relationship between the horizontal angle $\phi$ and each of the multiplication coefficients $k_1$ to $k_{12}$ is shown in FIG. 9. FIG. 9 shows a variation for each of the multiplication coefficients $k_1$, $k_2$, $k_3$, $k_4$ and $k_{12}$ in connection with the horizontal angle $\phi$. When comparing two coefficients $k_j$ and $k_{j-1}$ (where $2 \leqq j \leqq 12$), a waveshape of the coefficient $k_j$ is moved rightward by 30° from a waveshape of the coefficient $k_{j-1}$. The same thing can be said with respect to the other coefficients $k_5$ to $k_{11}$. Among the multiplication coefficients $k_1$ to $k_{12}$ respectively supplied to the multipliers 18*n*1 to 18*n*12**, two or less of them are set at "0" simultaneously.

Figure 10:
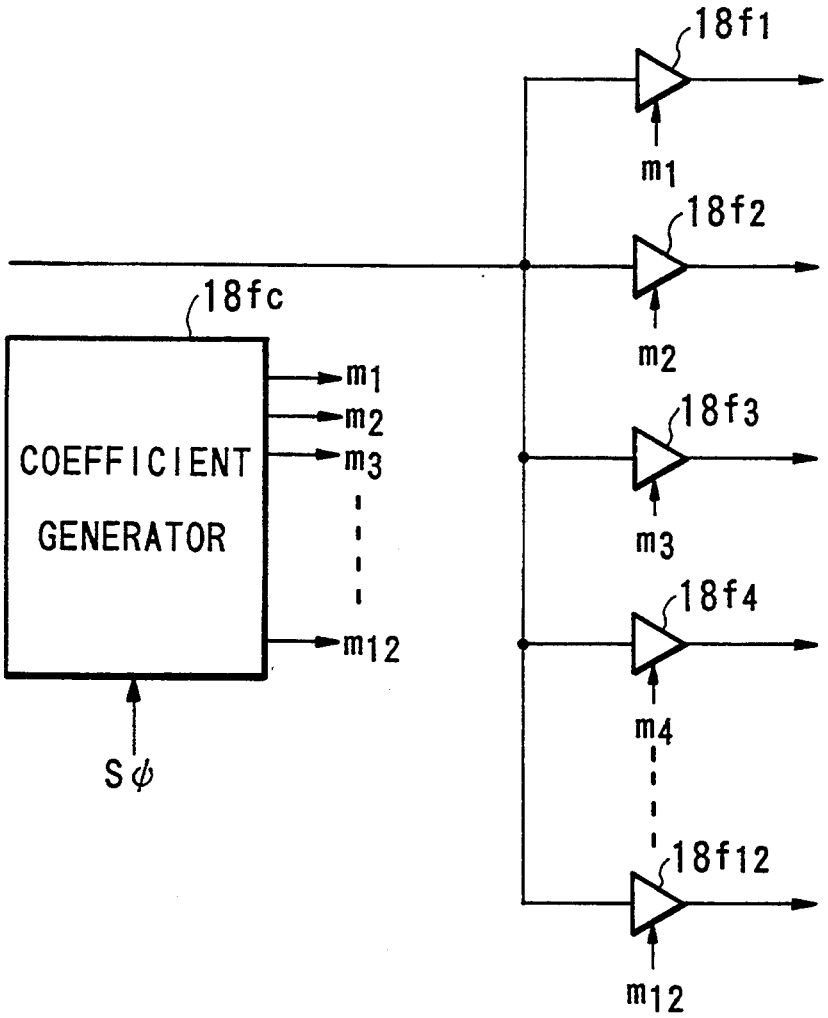
FIG. 10 is a block diagram showing a detailed configuration of an allocating unit for long distance shown in FIG. 6.
Figure 11:
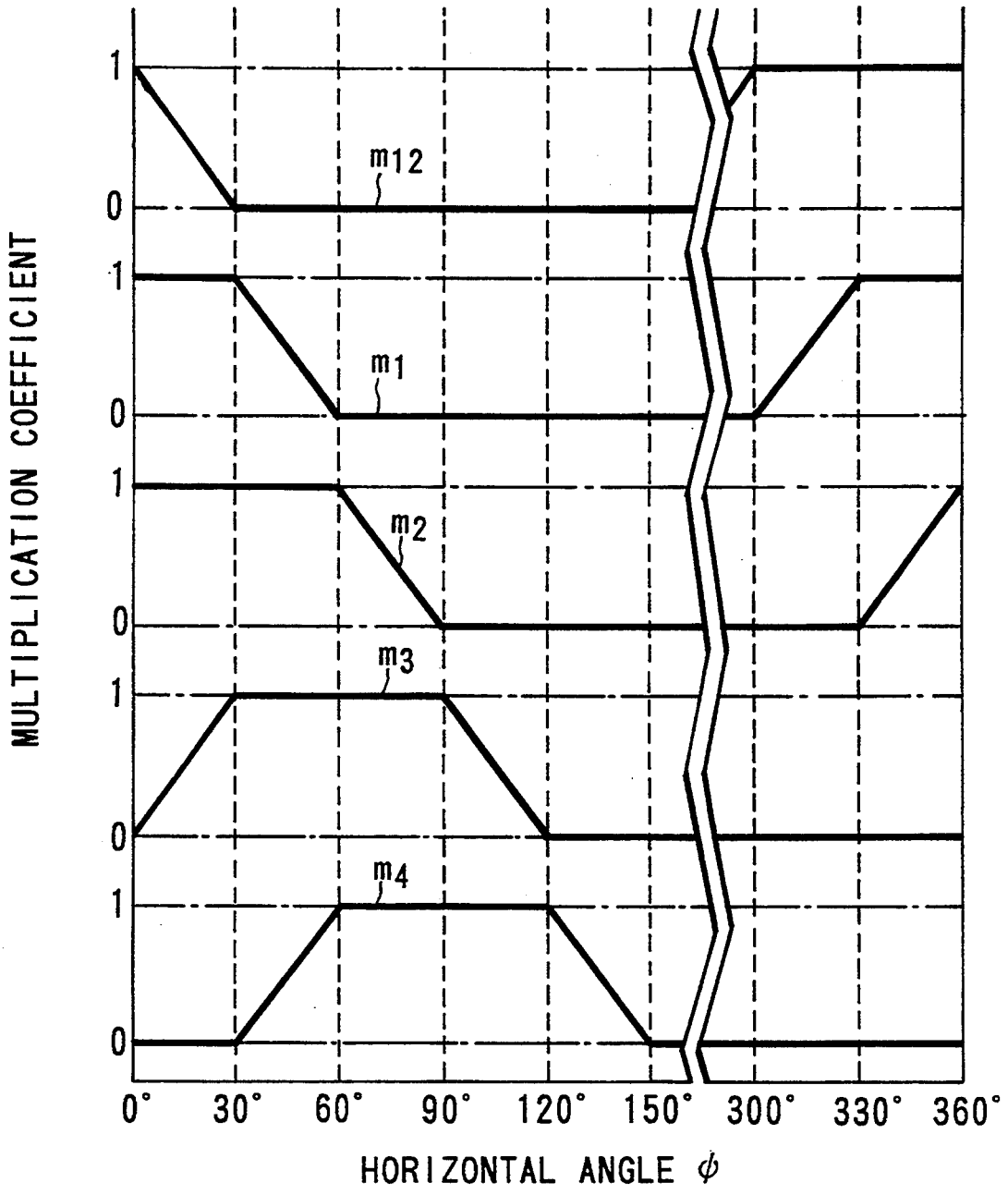
FIG. 11 is a graph showing a relationship between a horizontal angle and each of multiplication coefficients used for multipliers shown in FIG. 10.

In FIG. 6, a numeral **18*f* designates an allocating unit for long distance. This allocating unit 18*f* has one input and twelve outputs and is designed to allocate the output data of the multiplier 16*a* to the sound-directing devices. FIG. 10 shows a detailed configuration of the allocating unit 18*f*. In FIG. 10, a numeral 18*fc* designates a coefficient generator which determines multiplication coefficients $m_1$ to $m_{12}$ respectively supplied to multipliers 18*f*1 to 18*f*12** in response to the horizontal angle $\phi$. A relationship between the horizontal angle $\phi$ and each of the multiplication coefficients $m_1$ to $m_4$ and $m_{12}$ is shown in FIG. 11. When comparing the multiplication coefficients $m_j$ and $m_{j-1}$, a waveshape of the multiplication coefficient $m_j$ is moved rightward by 30° from a waveshape of the multiplication coefficient $m_{j-1}$. The same thing can be said with respect to the other multiplication coefficients $m_5$ to $m_{11}$.

Among the multiplication coefficients supplied to the multipliers **18*f*1 to 18*f*12 provided in the allocating unit 18*f***, three or more of them are simultaneously set in a positive state.

Figure 2:
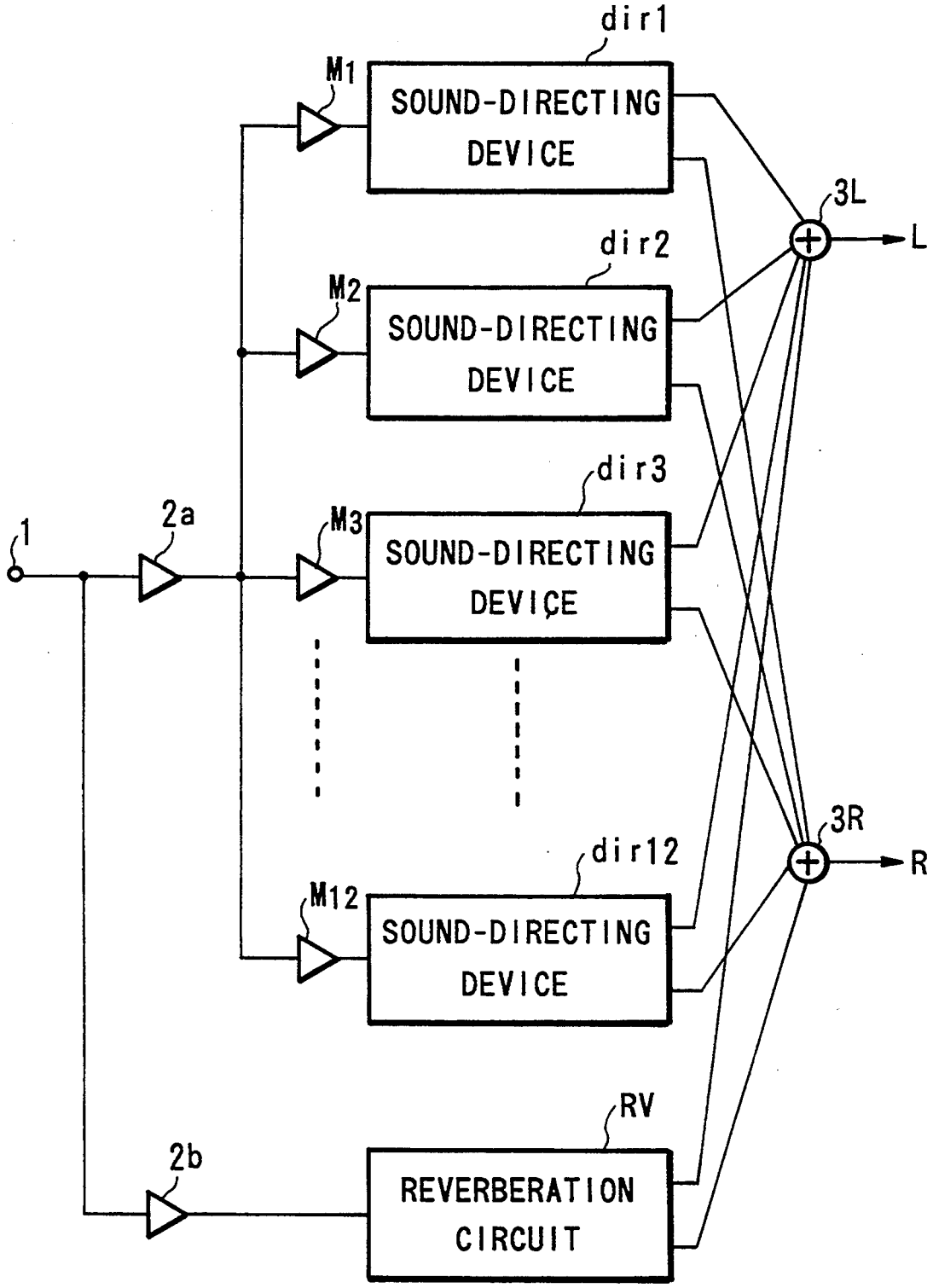
FIG. 2 is a block diagram showing an example of the sound localization control apparatus.
Figure 3:
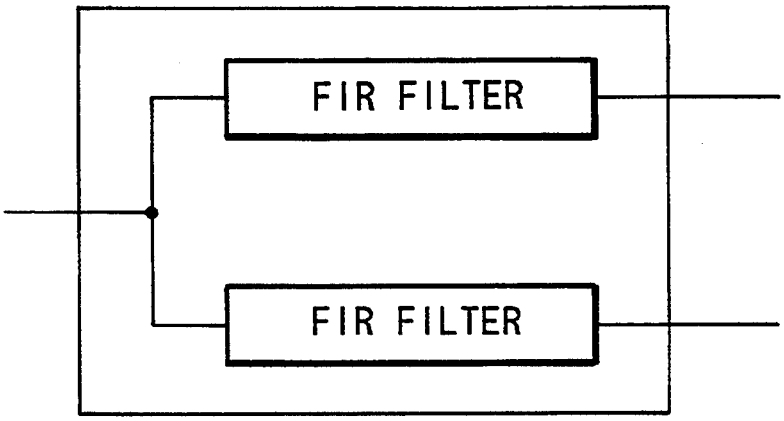
FIG. 3 is a block diagram showing a detailed configuration for each of sound-directing devices shown in FIG. 2.
Figure 4:
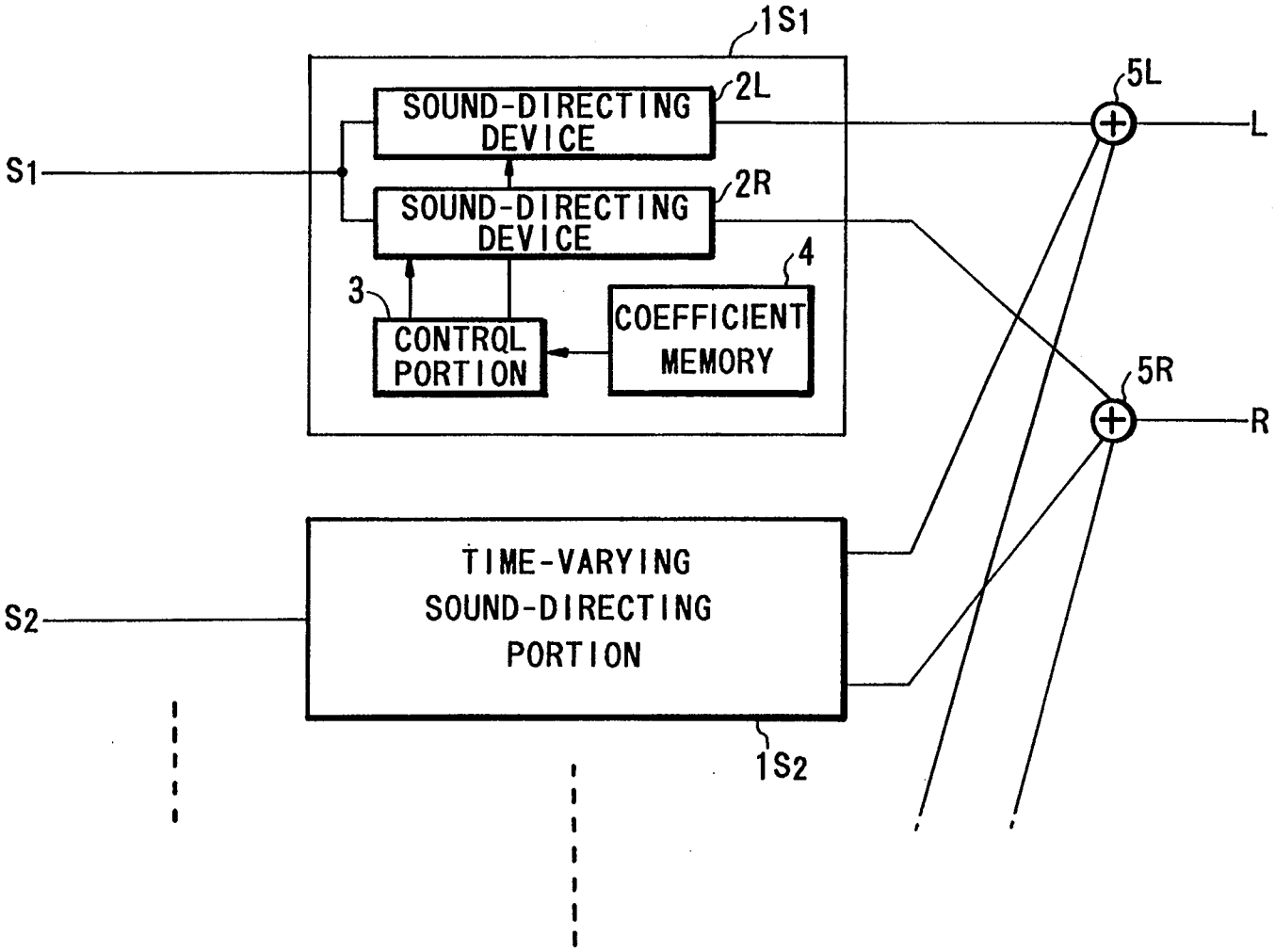
FIG. 4 is a block diagram showing another example of the sound localization control apparatus employing the coefficient time-varying method.
Figure 5:
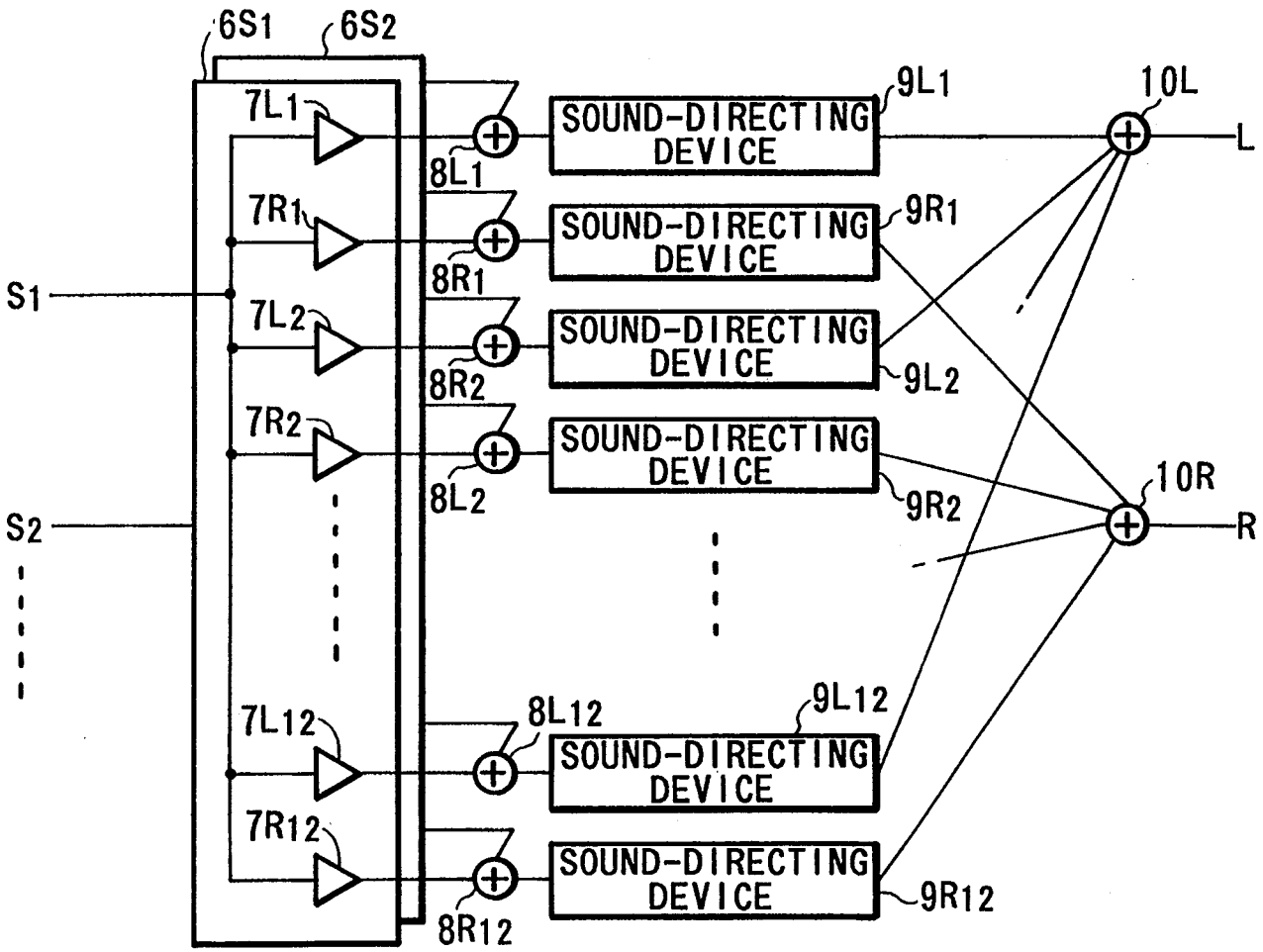
FIG. 5 is a block diagram showing a still another example of the sound localization control apparatus employing the virtual speaker method.

In FIG. 6, symbols FIR1 to FIR12 designate sound-directing devices which are similar to the aforementioned sound-directing devices dir1 to dir12 shown in FIG. 2. Each of the sound-directing devices FIR1 to FIR12 performs a data processing responsive to the horizontal angle $\phi$ and the distance D in connection with the target sound-image location.

Further, a numeral 19R designates an adder which adds right-channel components of the output data of the sound-directing devices FIR1 to FIR12 so as to form right-channel acoustic data. On the other hand, an adder 19L adds left-channel components of the output data of the sound-directing devices FIR1 to FIR12 so as to form left-channel acoustic data.

Moreover, a cross-talk canceller 20 performs a predetermined anti-cross-talk processing on the right-channel acoustic data and the left-channel acoustic data respectively outputted from the adders 19R and 19L, thus eliminating a cross-talk component which is occurred between the right-channel and left-channel sounds when actually reproducing the sounds in the predetermined space. Then, the right-channel acoustic data and the left-channel acoustic data respectively processed by the cross-talk canceller 20 are supplied to speakers (not shown) through an amplifier 21.

When activating the apparatus shown in FIG. 6, a person operates the slide switches 14*a*, 14*b* and the dial control 14*c* provided in the sound localization controller 14 so as to set the vertical angle $\theta$, the distance D and the horizontal angle $\phi$ respectively in connection with the target sound-image location. Next, a sound producing unit (not shown) supplies the acoustic data to the notch filter 15 through the input terminal 11. Since the vertical angle data $S\theta$ corresponding to the vertical angle $\theta$ has been already applied to the notch filter 15, the notch filter 15 performs a data processing on the acoustic data in response to the vertical angle $\theta$. Thus, the output data of the notch filter 15 represents the acoustic data to which a sound localization process has been carried out with respect to the vertical angle. The output data of the notch filter 15 is delivered to both of the multipliers 16*a* and 16*b*.

Meanwhile, the control portion 17 receives the distance data SD corresponding to the distance D from the sound localization controller 14. On the basis of the distance data SD, the control portion 17 determines a dividing rate for the acoustic data so as to set an amount of the acoustic data on which a data processing for long distance is carried out. Based on the dividing rate determined, the control portion 17 computes the multiplication coefficients "a" and "b" to be supplied to the multipliers 16*a* and 16*b* respectively.

The output data of the notch filter 15 is multiplied by the multiplication coefficient "a" by the multiplier 16*a*, so that a result of the multiplication is supplied to the allocating unit 18*f* for long distance. On the other hand, the output data of the notch filter 15 is multiplied by the multiplication coefficient "b" by the multiplier 16*b*, so that a result of the multiplication is supplied to the allocating unit 18*n* for short distance.

As described before, the allocating unit 18*n* performs a data processing in response to the horizontal angle $\phi$ (e.g., 45°) with respect to the target sound-image location. When embodying the horizontal angle of 45°, the coefficient generator 18*nc* in the allocating unit 18*n* sets the multiplication coefficients $k_1$ to $k_{12}$ for the multipliers 18*n*1 to 18*n*12 such that the same amount of data is supplied to the sound-directing devices FIR2 and FIR3 which respectively correspond to the horizontal angles of 30° and 60°.

Similarly, in the allocating unit 18*f*, the coefficient generator 18*fc* sets the multiplication coefficients $m_1$ to $m_{12}$ for the multipliers 18*f*1 to 18*f*12 with respect to the sound source, the location of which is far from the location of the listener. In order to allocate the acoustic data to the sound-directing devices, the directions of which are slightly apart from the target sound-image direction, an allocating rate for the sound-directing device FIR1 is set at 0.1; allocating rates for the sound-directing devices FIR2 and FIR3 are both set at 0.4; and an allocating rate for the sound-directing device FIR4 is set at 0.1, for example. As described above, when the target sound-image location is relatively far from the location of the listener, a directional component for the target sound-image location is somewhat diffused so as to eventually apply a long-range distance effect to the sound image to be localized.

The output data of the allocating unit 18*n* for short distance (i.e., short-distance data) are adequately added with the output data of the allocating unit 18*f* for long distance (i.e., long-distance data), resulting that interpolation operations are carried out on the above long-distance data and short-distance data; in other words, the long-distance data and the short-distance data are adequately mixed together. Then, mixed data is supplied to each of the sound-directing devices FIR1 to FIR12. Each of the data supplied to the sound-directing devices FIR1 to FIR12 is divided into the right-channel component and left-channel component on which the predetermined convolution operation is carried out. Thereafter, the left-channel components outputted from the sound-directing devices FIR1 to FIR12 are added together by the adder 19L, while the right-channel components are added together by the adder 19R. The right-channel acoustic data and the left-channel acoustic data (i.e., two-channel binaural-signal data) respectively outputted from the adders 19L and 19R are supplied to the cross-talk canceller 20.

The cross-talk canceller 20 performs the anti-cross-talk processing on the right-channel acoustic data and the left-channel acoustic data so as to eventually eliminate the cross-talk components. The cross-talk components are occurred in response to a position relationship among the listener and two speakers. More specifically, a part of the right-channel sound is transmitted to the left ear of the listener, while a part of the left-channel sound is transmitted to the right ear of the listener. Those parts of the sounds will form the cross-talk components. After being processed by the cross-talk canceller 20, the right-channel acoustic data and the left-channel acoustic data are amplified by the amplifier 21; and then, they are supplied to left and right speakers (not shown), from which stereophonic sounds are produced.

According to the aforementioned configuration of the sound localization control apparatus according to the first embodiment of the present invention, as a distance between the listener and the target sound-image location becomes larger, a sound localization to be controlled becomes unclear. Thus, even if a long distance is existed between the listener and the target sound-image location, it is possible to impart a natural sound localization effect to the sounds produced from the speakers.

In the first embodiment described heretofore, a plurality of sound-directing devices are provided such that each of them corresponds to a predetermined direction, while a rate of the acoustic data to be allocated to each sound-directing device is adjusted. Further, a pair of the coefficients which represent the head-related transfer function and which also correspond to one predetermined direction are supplied to each of the sound-directing devices. Instead, an average among three or more pairs of the coefficients which respectively correspond to three or more directions can be supplied to each sound-directing device so as to intentionally weaken tile sound localization effect (or make the sound-image location unclear).

In the aforementioned embodiment, the sound-directing devices are provided with respect to twelve directions which are arranged in a horizontal plane. However, at least three horizontal directions are required when localizing the sounds. Therefore, the number of the sound-directing devices is not limited to twelve. The aforementioned embodiment employs the notch filter 15 in order to localize the sounds in the vertical direction. This notch filter 15 can be replaced by the sound-directing device and the like, because the sound-directing device can also perform the sound localization with respect to the vertical direction.

In the aforementioned embodiment, only one channel of the acoustic data is inputted to the apparatus. However, by increasing the number of the circuits each having the configuration as shown in FIG. 6, it is possible to simultaneously perform the sound localization with respect to plural channels of the acoustic data.

In order to convert the acoustic data (i.e., binaural signals) into the sounds which are produced from the speakers, the aforementioned embodiment utilizes the cross-talk canceller 20. However, when listening to the sounds by a headphone set, the cross-talk canceller 20 can be omitted from the circuitry shown in FIG. 6.

[B] Second Embodiment

A first feature of the second embodiment lies in that the sound-directing device conventionally used is divided into two parts. This feature will be described in conjunction with FIG. 12.

Figure 1:
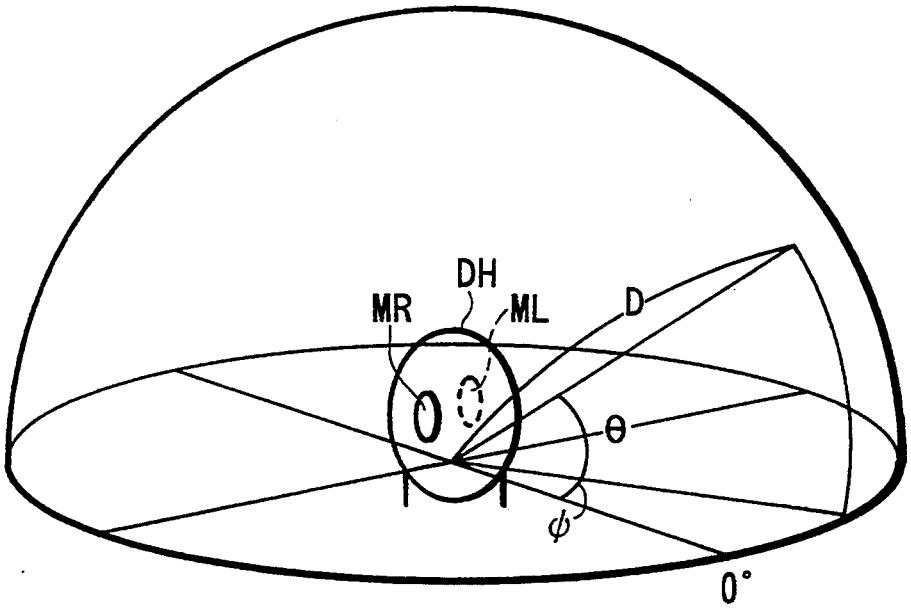
FIG. 1 is a drawing showing a virtual space in which a dummy head is provided so that the sounding effects are experimentally measured so as to obtain a head-related transfer function.
Figure 12:
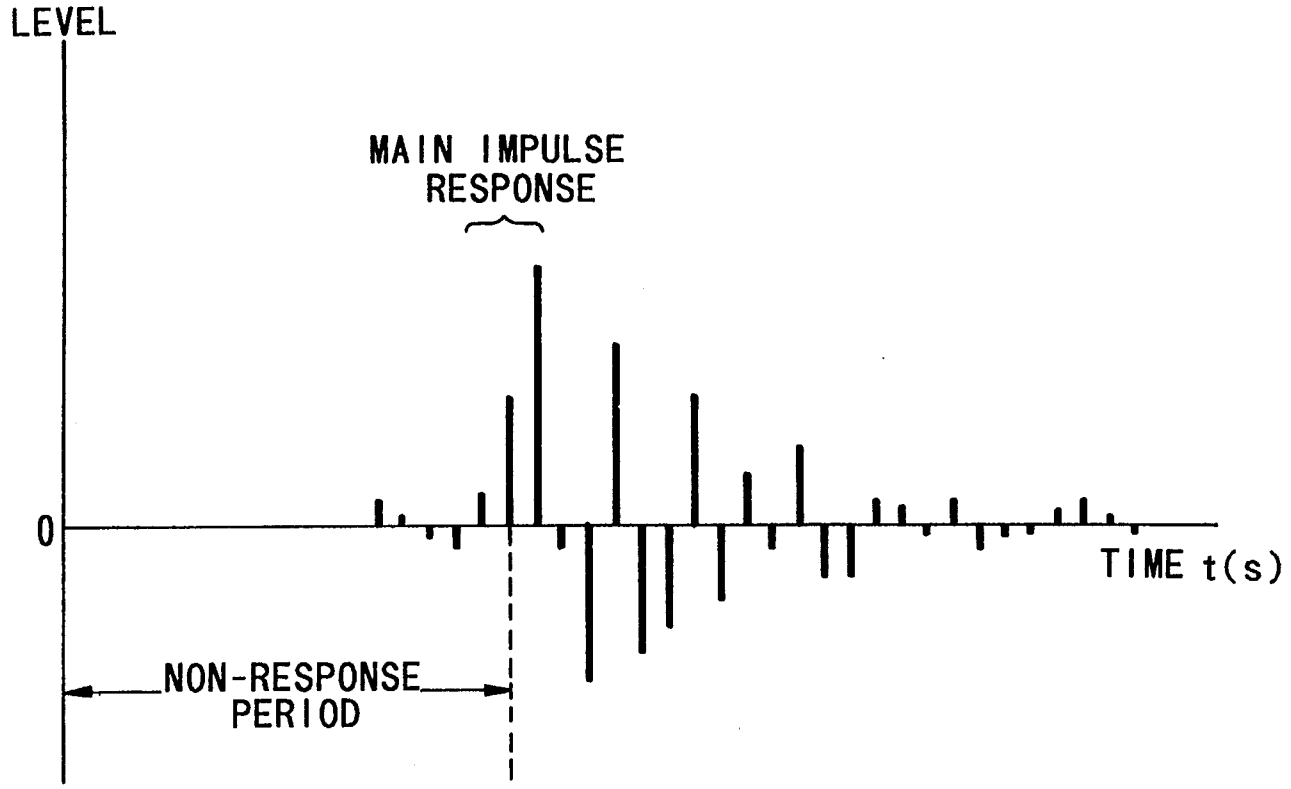
FIG. 12 is a graph showing an example of the impulse response characteristic.

When an impulse sound is applied to the dummy head DH (see FIG. 1) at a moment t=0, such impulse sound is picked up by the microphones ML and MR which are provided in the dummy head DH, so that the corresponding impulse response is obtained. FIG. 12 is a graph showing a variation of the impulse response with respect to time t(s).

According to FIG. 12, it is observed that an impulse-response level is zero (or very small) for a certain period of time after the moment t=0 (s); and then, an initial impulse response having a low level is occurred; and a main impulse response having a high level is occurred; thereafter, the impulse-response level is gradually reduced in a lapse of time. The impulse-response waveform depends on the location at which the impulse sound is produced. However, the impulse-response waveform as shown in FIG. 12 (in which a variation of the impulse-response level is indicated in a digital manner) shows a typical waveform for the impulse-response waveforms generally obtained.

Under the consideration of the above-mentioned impulse-response waveform, the present embodiment ignores the small initial impulse response. In other words, the present embodiment delays an initial period until the main impulse response is occurred as the delay time. Therefore, in such initial period (i.e., delay time), the present embodiment does not perform the data processing by use of the sound-directing device. Of course, it is possible to perform the data processing on the initial impulse response, whereas such data processing results in the complicated control to be required when performing the delay operation in the second embodiment. Since the initial impulse response does not substantially affect the sound localization, the initial impulse response can be separated from the main impulse response.

Thus, the present embodiment uses the FIR filter as the sound-directing device dealing with the main impulse responses. In the sound-directing device conventionally used, the coefficients are set at zero during the initial period. In contrast, the present embodiment embodies the data processing corresponding to the above initial period by the delay portion which is separated from the sound-directing device. In the second embodiment, the FIR filter which corresponds to the main impulse responses is called as the sound-directing device.

A second feature of the second embodiment lies in that a number of the delay portions (each of which is separated from the sound-directing device as described above) is set identical to a number of the acoustic data applied to the apparatus, while a pair of the sound-directing devices are provided with respect to each of the acoustic data. The above-mentioned first and second features of the present embodiment will result in the clear sound localization effect and low system cost. The reasons will be described below.

In the sound localization control apparatus, the most important element which is required for obtaining the sound localization effect is a difference between times at which sound waves are respectively sensed by left and right ears of the person or a difference between amplitudes of those sound waves. This is because the person monitors the sound-image direction by use of the left and right ears.

The above-mentioned element may be effective when monitoring the sound-image location with respect to the horizontal direction. However, that element is not so effective when monitoring the sound-image location with respect to the vertical direction or the distance. For this reason, the aforementioned head-related transfer function is introduced to accurately respond to the sound-image location, sensed by the person, which is affected by a scattering manner and a reflection manner of the sound waves as well as the shape of the human head and the shape of the ears. By use of the head-related transfer function, it is possible to obtain the sound localization effect with respect to all of the factors including the vertical direction and the distance. Incidentally, the sound-localization control in the vertical direction can be simply embodied by use of the notch filter.

When observing each of tile digital data representing the impulse-response waveforms picked up by the left and right ears, there exists a non-response period from a moment t=0 (s). In the non-response period (see FIG. 12), the impulse-response levels are almost at zero. Due to tile existence of the non-response period with respect to each of the impulse-response waveforms respectively picked up by the left and right ears, it is well known that a time difference between non-response periods respectively corresponding to the sound waves picked up by the left and right ears may be one of the most important elements when obtaining the sound localization effect. Because, a distance between the sound source and the left ear is different from a distance between the sound source and the right ear, resulting that an arrival time (i.e., non-response period) by which the sound wave reaches the left ear is different from an arrival time by which the sound wave reaches the right ear, in other words, an amplitude of the sound wave transmitted to the left ear is different from that of the sound wave transmitted to the right ear. Further, it is well known that an amplitude difference between the main impulse responses respectively corresponding to the left and right ears may be another one of the most important elements. In the second embodiment, the above-mentioned time difference is embodied by the delay portion, while the amplitude difference is embodied by the multiplier which functions to adjust the amplitude. The delay portion and the multiplier are provided independently of the sound-directing device.

The delay portion can be configured by a random-access memory (i.e., RAM) and an address control portion. Herein, it is necessary to provide a memory capacity for the RAM by which the data corresponding to the delay time can be stored; and the address control portion is provided to control a write address and a read address for the RAM. Due to such simple configuration of the delay portion, it is possible to manufacture the delay portion with a low cost. Further, it is necessary for the multiplier to perform the multiplication using the multiplication coefficient such that an amplitude of the impulse-response waveform can be adjusted. Therefore, this multiplier can be also manufactured with a low cost. Since a combination of the delay portion and the multiplier adjusting the amplitude is the most important circuit portion for the second embodiment, it should be provided independently for each of the acoustic data applied to the apparatus. However, the system cost required for the apparatus will not be raised up so much.

Meanwhile, the sound-directing device is provided to perform the convolution operation on the main impulse responses. However, if a plenty of the sound-directing devices are provided such that the sound sources corresponding thereto are tightly arranged in the space, the apparatus cannot be manufactured with a low cost. For this reason, the present embodiment limits the number of the sound-directing devices at twelve, the number of which corresponds to twelve horizontal directions to be arranged with respect to the predetermined distance. Therefore, as similar to the foregoing virtual speaker method, a weighted allocation is carried out on the acoustic data when allocating the acoustic data to the sound-directing devices respectively so as to eventually localize the sound image at the target sound-image location. In the second embodiment, the delay time is adjusted by the delay portion provided before the sound-directing device. Thus, different from the virtual speaker method, even if the sounds-image location is put at a certain location between the locations respectively corresponding to the sound-directing devices, it is possible to obtain a clear sound-image localization effect.

In order to control the sound localization in the vertical direction by use of the notch filter, at least two sound-directing devices are required theoretically, because one of the sound-directing devices covers an upper portion of the space, while the other covers a lower portion of the space. Those two sound-directing devices may be effective when obtaining a certain degree of the sound localization effect in the vertical direction. Through the experiments, it is known that more than four sound-directing devices are effective when controlling the sound localization effect in the vertical direction. Since the multiplier which performs the multiplication to adjust the amplitude of the main impulse response is provided independently of the sound-directing device, it is possible to normalize the coefficients used for the sound-directing devices.

As described above, operations which are required to control a certain portion of the impulse-response waveform in real time can be embodied by the delay operation, amplitude adjusting operation and allocation operation which can be controlled easily. Herein, the delay operation is performed by the delay portion, while the other operations are performed by the multipliers. Thus, the second embodiment does not require a high-speed processor; in other words, even a general-use processor can satisfy the needs of the second embodiment. As described before, the sound-directing device is inevitably configured by a large-scale circuitry. However, different from the aforementioned coefficient time-varying method, it is not necessary to change the coefficients in the second embodiment. Thus, the second embodiment does not require the super-high-speed processor as the sound-directing device. Further, the number of the sound-directing devices can be reduced in the second embodiment. For example, some sound-directing devices or ten or more sound-directing devices are sufficient in the second embodiment. Furthermore, each sound-directing device can be commonly used for plural acoustic data. For these reasons, the system cost required for manufacturing the apparatus of the second embodiment may not be raised up so much. In the meantime, all of the delay-time difference, amplitude difference and head-related transfer function are set in an ideal state as if the sound image may really exist at a desired location. Thus, as compared to the virtual speaker method in which the virtual speakers are arranged not so tightly in the space, the second embodiment can achieve a very clear sound localization effect.

(1) Configuration of Second Embodiment

Figure 13:
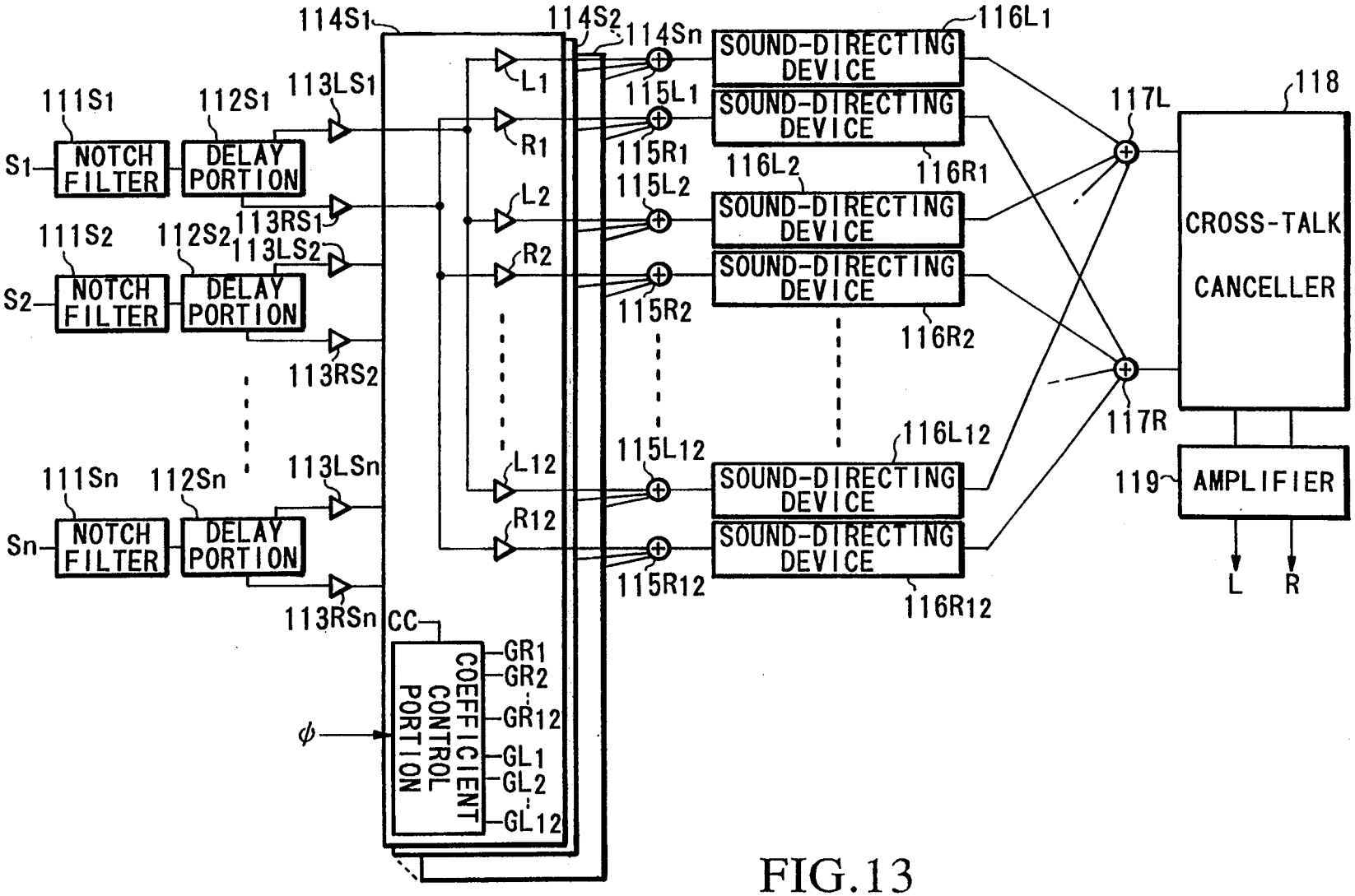
FIG. 13 is a block diagram showing an electronic configuration of a sound localization control apparatus according to a second embodiment of the present invention.

FIG. 13 is a block diagram showing a diagrammatical configuration of the sound localization control apparatus according to the second embodiment of the present invention. The apparatus shown in FIG. 13 is designed to respond to plural acoustic data S1 to Sn, the number of which is set at "n" (where "n" denotes an integral number).

In FIG. 13, numerals 111S1 to 111Sn designate notch filters respectively receiving the acoustic data S1 to Sn. Each of the notch filters performs a frequency-band eliminating process on each acoustic data so as to remove a certain vertical-direction component from the acoustic data, wherein the vertical-direction component has a certain frequency band with respect to the vertical direction of the target sound-image location. That notch filter is controlled responsive to a parameter NC given from a controller MM1, the details of which will be described later. Thus, the acoustic data which has been processed by the notch filter represents a sound image which has been localized in the vertical direction with respect to the target sound-image location.

Next, numerals 112S1 to 112Sn designate delay portions respectively receiving the output data of the notch filters 111S1 to 111Sn. Each of the delay portions separate the output data of the notch filter into a left-channel component and a right-channel component, which are respectively delayed in response to distances DL and DR. Herein, "DL" designates a distance between the left-side microphone ML and the target sound-image location, while "DR" designates a distance between the right-side microphone MR and the target sound-image location. The abovementioned left-channel component and right-channel component for the acoustic data are respectively delayed by delay-time parameters DTL and DTR which are given from the controller MM1. A pair of multipliers 113LS1 and 113RS1 is coupled with the delay portion 112S1, while a pair of multipliers 113LS2 and 113RS2 is coupled with the delay portion 112S2, so that each pair of the multipliers 113LS1 to 113LSn and 113RS1 to 113RSn is coupled with each of the delay portions 112S1 to 112Sn. Each pair of the multipliers receives the output data of each delay portion so as to multiply the left-channel component and right-channel component by attenuation coefficients gL and gR respectively. Those attenuation coefficients gL and gR are given from the controller MM1. By the multiplications respectively performed by two multipliers coupled with each delay portion, the left-channel component and the right-channel component are respectively controlled such that a left-channel tone volume and a right-channel tone volume (or left-channel and right-channel amplitudes) are respectively adjusted to be matched with the target sound-image location.

Numerals 114S1 to 114Sn designate allocating units respectively receiving the outputs of the multipliers 113LS1 to 113LSn and 113RS1 to 113RSn. Each of the allocating units performs a predetermined weighted-allocating operation on the left-channel component and right-channel component for each of the acoustic data S1 to Sn. For example, the allocating unit 114S1 receives the left-channel component and right-channel component for the acoustic data S1, which are given from the multipliers 113LS1 and 113RS1 coupled with the delay portion 112S1. In the allocating unit, the left-channel component for the acoustic data is divided into twelve left-channel components with respect to twelve horizontal directions, while the right-channel component for the acoustic data is divided into twelve right-channel components with respect to twelve horizontal directions. The allocating unit 114S1 is configured by a coefficient controller CC and multipliers L1 to L12 and R1 to R12.

Figure 14:
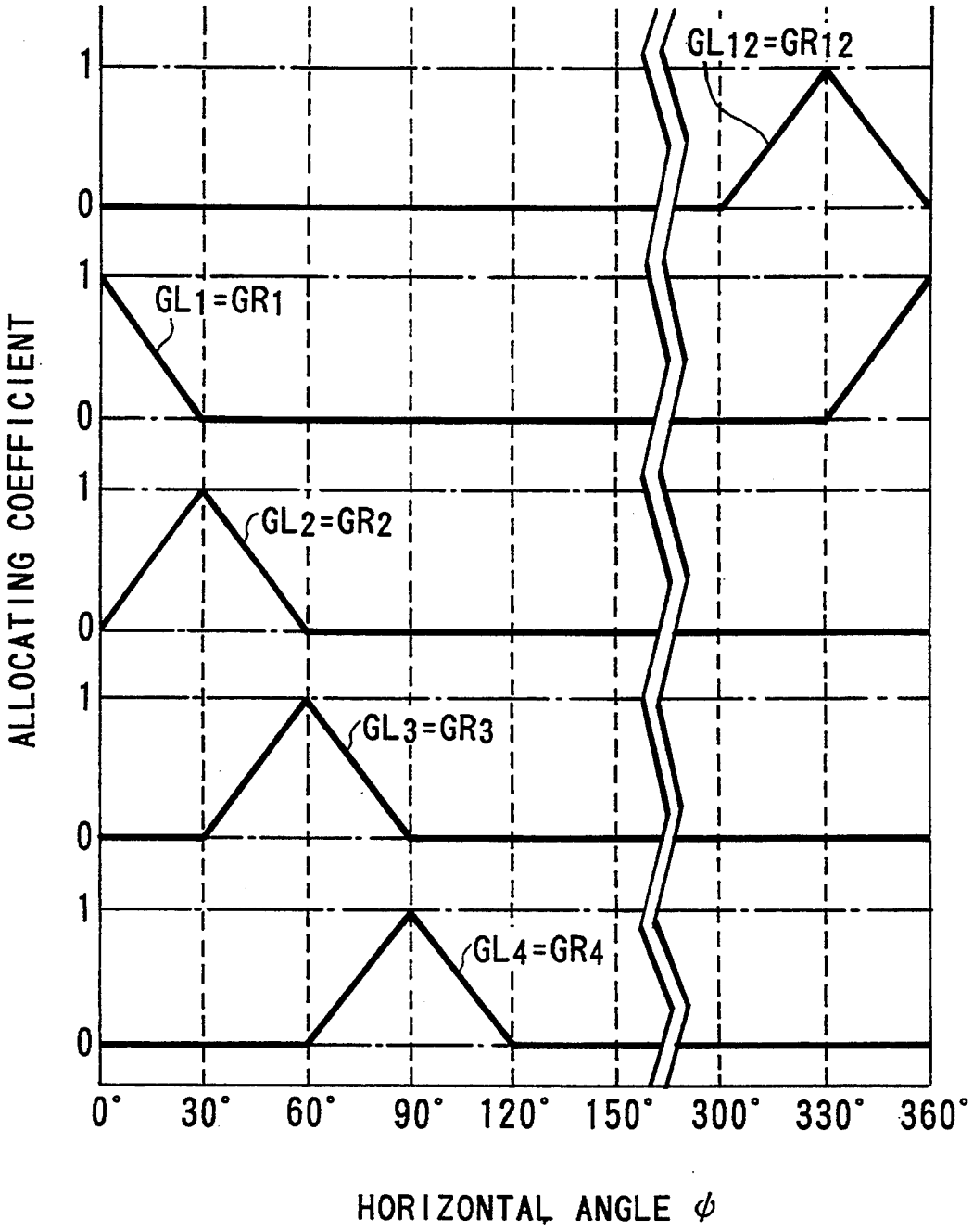
FIG. 14 is a graph showing a relationship between each allocating coefficient and the horizontal angle $\phi$.

The coefficient controller CC creates multiplication coefficients $GL_1$ to $GL_{12}$ and $GR_1$ to $GR_{12}$ in response to the horizontal angle $\phi$. Those multiplication coefficients are respectively set as shown in FIG. 14. Incidentally, the multiplication coefficient $GL_j$ (where $1 \leqq j \leqq 12$) is set equal to the multiplication coefficient $GR_j$. When comparing two multiplication coefficients $GL_j$ and $GL_{j-1}$ (where $2 \leqq J \leqq 12$), a waveshape of the multiplication coefficient $GL_j$ is moved rightward by 30° from a waveshape of the multiplication coefficient $GL_{j-1}$. The same thing can be said with respect to all of the multiplication coefficients GL1 to GL12 and GR1 to GR12.

As shown in FIG. 14, if the horizontal direction represented by the horizontal angle $\phi$ corresponds to only one sound-directing device, only one multiplication coefficient is set at "1", while the other multiplication coefficients are all set at "0". On the other hand, if the horizontal direction represented by the horizontal angle $\phi$ does not correspond to any one of the sound-directing devices, two multiplication coefficients corresponding to two sound-directing devices which are arranged close to that horizontal direction are set in a positive state, while the other multiplication coefficients are set at "0".

In the allocating unit 114S1 shown in FIG. 13, the multipliers L1 to L12 respectively perform the multiplications using the multiplication coefficients $GL_1$ to $GL_{12}$ on the left-channel component given from the multiplier 113LS1, while the multipliers R1 to R12 respectively perform the multiplications using the multiplication coefficients $GR_1$ to $GR_{12}$ on the right-channel component given from the multiplier 113RS1.

The other allocating units 114S2 to 114Sn have the similar configuration and operation of the allocating unit 114S1; hence, the detailed description thereof will be omitted.

Next, numerals 115L1 to 115L12 and 115R1 to 115R12 designate adders receiving the outputs of the allocating units 114S1 to 114Sn. Herein, the adder 115L1 adds a left-channel allocated component outputted from the multiplier L1 of the allocating unit 114S1 with similar components respectively outputted from the allocating units 114S2 to 114Sn, while the adder 115R1 adds a right-channel allocated component outputted from the multiplier R1 of the allocating unit 114S1 with similar components respectively outputted from the allocating units 114S2 to 114Sn. Similarly, each of the adders 115L2 to 115L12 adds the left-channel allocated components together which are respectively outputted from the allocating units 114S1 to 114Sn, while each of the adders 115R2 to 115R12 adds the right-channel allocated components together which are respectively outputted from the allocating units 114S1 to 114Sn.

Numerals 116L1 to 116L12 and. 116R1 to 116R12 designate sound-directing devices, each of which performs the convolution operation on the basis of a pair of coefficients corresponding to the head-related transfer function. Incidentally, the abovementioned pair of coefficients is set responsive to the main impulse response and its continuous response which are occurred after the initial impulse response. Herein, the sound-directing devices 116L1 to 116L12 respectively perform the convolution operations on the output data of the adders 115L1 to 115L12, while the sound-directing devices 116R1 to 116R12 respectively perform the convolution operations on the output data of the adders 115R1 to 115R12. In the meantime, the sound-directing device 116L1 corresponds to the horizontal angle of 0°; the sound-directing device 116L2 corresponds to the horizontal angle of 30°; and the sound-directing device 116L12 corresponds to the horizontal angle of 330°. In short, each of the sound-directing devices 116L1 to 116L12 provided for the left-channel allocated components is set responsive to every 30° in the horizontal direction. Similarly, each of the sound-directing devices 116R1 to 116R12 provided for the right-channel allocated components is set responsive to every 30° in the horizontal direction.

Next, an adder 117L adds the output data of the sound-directing devices 116L1 to 116L12 together so as to form the left-channel acoustic data, while an adder 117R adds the output data of the sound-directing devices 116R1 to 116R12 together so as to form the right-channel acoustic data. A cross-talk canceller 118 performs the aforementioned anti-cross-talk processing on the left-channel acoustic data and right-channel acoustic data respectively outputted from the adders 117L and 117R. As described before, the cross-talk components which are inevitably occurred in response to the position relationship between the listener and the speakers provided in the predetermined space can be removed from the left-channel and right-channel acoustic data by performing the anti-cross-talk processing.

An amplifier 119 converts the left-channel and right-channel acoustic data given from the cross-talk canceller 118 into analog acoustic signals. Then, the acoustic signals are amplified and then supplied to the speakers (not shown), from which the stereophonic sounds are produced.

Figure 15:
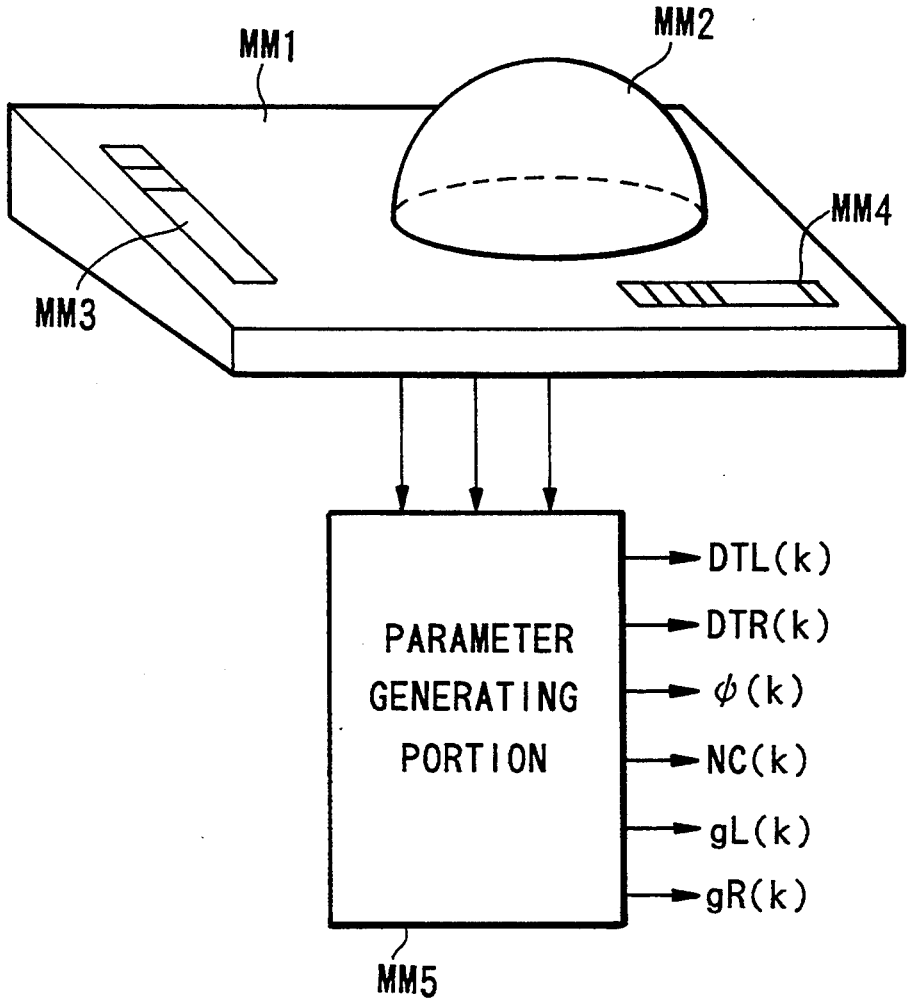
FIG. 15 is a perspective-side view illustrating an appearance and a partial configuration of a controller which is used to designate a sound-image location.

FIG. 15 shows an appearance and a partial configuration of the controller MM1, which is designed to designate the target sound-image locations in real time. This controller MM1 is manipulated by an operator (not shown) who may stand in front of the controller MM1. There are provided a touch sensor MM2 having a semi-spherical form, a slide switch MM3 and a select switch unit MM4 on a panel face of the controller MM1. Herein, the slide switch MM3 is provided to control the distance, while the select switch unit MM4 is provided to selectively designate one of plural acoustic data applied to the apparatus. Incidentally, a numeral MM5 designates a parameter generating portion, which is equipped within a main body of the controller MM1. However, for convenience sake, an illustration of the parameter generating portion MM5 is shown outside the controller MM1 in FIG. 15.

On a surface of the semi-spheric touch sensor MM2, a plurality of voltage-sensitive lines (not shown) are laid as longitude lines and latitude lines. Herein, a certain interval which may correspond to a width of a finger tip is provided between adjacent voltage-sensitive lines; and an insulation is only effected at an intersection between the longitude line and the latitude line, whereas the other portions of the semi-spheric surface of the touch sensor MM2 are not insulated. When a finger of the person touches the surface of the semi-spheric touch sensor MM2, a potential between the longitude line and latitude line is reduced in connection with a touching point. By detecting the potential reduced, it is possible to detect the touching point. Thus, it is possible to obtain longitude data and latitude data with respect to the touching point on the basis of a predetermined reference point. Herein, the longitude data may correspond to the foregoing horizontal angle $\phi$, while the latitude data may correspond to the foregoing vertical angle $\theta$. The scale which is designated by the slide switch MM3 ranges from 0.2 m to 20 m. In other words, the shortest distance of 0.2 m can be designated by sliding the actuator of the slide switch MM3 in a front direction, while the longest distance of 20 m can be designated by sliding the actuator of the slide switch MM3 in a back direction. By operating the slide switch MM3, it is possible to obtain distance data D designating a desired distance between the listener and the target sound-image location. By pushing one of the switches provided in the select switch unit MM4, it is possible to select one of the acoustic data applied to the apparatus. When pushing one switch, a value k (where $1 \leqq k \leqq n$) designating a serial number of the acoustic data to be controlled is outputted.

Based on the above-mentioned data $\phi$, $\theta$, D and k, the parameter generating portion MM5 generates several kinds of parameters which are supplied to the sound localization control apparatus. For example, the parameter generating portion MM5 generates the parameters representing delay times DTL(k), DTR(k), a horizontal-direction component $\phi$(k), a notch-filter coefficient NC(k) and attenuation coefficients gL(k) and gR(k) with respect to the acoustic data Sk.

(2) Operation of Second Embodiment

Next, the description will be given with respect to the operation of the apparatus which functions to localize the sounds at the target sound-image location. For example, a synthesizer (not shown) is activated to produce the running sounds of the car, while those sounds are produced from two speakers (not shown) so that the listener can hear those sounds. Incidentally, the speakers are respectively arranged in front of the listener such that the sounds are produced from a left-side slanted direction and a right-side slanted direction. Acoustic signals corresponding to the running sounds of the car produced from the synthesizer are converted into acoustic data S1. The acoustic data S1 representing the running sounds of the car are sequentially applied to the apparatus in which those data are subjected to data processings as described before, so that the corresponding sounds are produced from two speakers.

When performing a sound effect in which the running sounds of the car are altered as if the car is running from the right to the left, the operator of the controller MM1 (e.g., listener) touches a right-side portion of the semi-spheric surface of the touch sensor MM2 by a finger (or a hand) at first; thereafter, the operator gradually moves his hand in a backward direction and then moves his hand in a leftward direction while touching the surface of the touch sensor MM2. Synchronized with the above motion, the operator gradually slides the actuator of the slide switch MM3 from a back-side position to a front-side position. Until the touching point at which the operator touches the surface of the touch sensor MM2 reaches a certain back-side position which is opposite to tile front position of the operator, the operator moves the actuator of the slide switch MM3 in a front direction. However, after the touching point reaches the above certain back-side position, the operator reverses an operation of the slide switch MM3 so that the operator begins to move the actuator in a backward direction. In accordance with the above-mentioned complicated operations applied to the touch sensor MM2 and the slide switch MM3 respectively in a synchronized manner, the controller MM1 sends out several kinds of parameters as described before.

Thus, the aforementioned delay portion 112S1 receives the delay-time parameters DTL(1) and DTR(1) from the controller MM1 in connection with the acoustic data S1. In this case, a right delay time DTR is set slightly shorter than a left delay time DTL at first. Thereafter, both of the delay times DTL and DTR are controlled to be shorter in accordance with the operations of the touch sensor MM2 and the slide switch MM3. A difference between those delay times DTL and DTR becomes equal to zero when the touching point on the semi-spheric surface of the touch sensor MM2 reaches the aforementioned certain back-side position which is opposite to the front position of the operator. Thereafter, a relationship between the delay times DTL and DTR is reversed, so that the left delay time DTL is set shorter than the right delay time DTR. In accordance with the operation of the slide switch MM3 by which the actuator is slid in a backward direction, both of the delay times DTL and DTR are controlled to be longer.

When the touching point is located at a right-side portion of the semi-spheric surface of the touch sensor MM2, a left attenuation coefficient gL(1) is set smaller than a right attenuation coefficient gR(1). However, as the touching point is moved in a leftward direction, a relationship between those coefficients is reversed. Further, as the actuator of the slide switch MM3 is moved in a front direction to be closer to the operator, a sum of the attenuation coefficients gL(1) and gR(1) becomes larger. Thereafter, as the actuator of the slide switch MM3 is moved in a backward direction to be far from the operator, the sum of the attenuation coefficients becomes smaller.

When the parameter generating portion MM5 generates the horizontal-direction component $\phi$(1) in connection with the touching point on the semi-spheric surface of the touch sensor MM2, the aforementioned multiplication coefficients (or allocating coefficients) $GL_1$ to $GL_{12}$ and $GR_1$ to $GR_{12}$ as shown in FIG. 14 with respect to the horizontal-direction component $\phi(1)$. At first, the operator touches the touch sensor MM2 at its right-side portion, the allocating coefficients $GL_4$ and $GR_4$ corresponding to $\phi=90°$ are set at "1". Thereafter, in synchronism with a moving operation of the touching point on the semi-spheric surface of the touch sensor MM2, the allocating coefficients $GL_3$ and $GR_3$ are reduced, while the allocating coefficients $GL_4$ and $GR_4$ are raised up. Such cross-altering manner between the coefficients $GL_3$, $GR_3$ and the coefficients $GL_4$, $GR_4$ is shown in FIG. 14 between the horizontal angles of 60° and 90°. When the touching point is located at the aforementioned back-side position which is opposite to the front position of the operator, the allocating coefficients $GL_1$ and $GR_1$ are set at "1". Then, the allocating coefficients are altered in the aforementioned cross-altering manner. Finally, the allocating coefficients $GL_{10}$ and $GR_{10}$ are set at "1". As described heretofore, the acoustic data are processed in accordance with the head-related transfer function so as to eventually obtain a clear sound localization effect. By the above-mentioned data processing, it is possible to alter the sound-image location in real time such that the running sounds of the car can be heard as if the car is really running in front of the listener from the right to the left.

The present embodiment can perform the sounding effects in which the sounds of the car are reproduced as if the car is running on the highways or the car is jumping in some competition games, for example. In such sounding effects, the vertical-direction components must be considered when localizing the sounds. In order to do so, the operator touches the touch sensor MM2 and moves the touching point with respect to the vertical direction, the controller MM1 produces the notch-filter coefficient NC(1) which responds to the vertical-direction component. The notch filter 111S1 is activated on the basis of the coefficient NC(1) so as to localize the sounds in a direction which is designated by the coefficient NC(1). In other words, the notch filter 111S1 performs the sound localization in the vertical direction by removing the predetermined frequency-band components from the first acoustic data S1. The above frequency band to be removed is altered in accordance with the touching point to be moved on the semi-spheric surface of the touch sensor MM2.

As described above, the second embodiment is characterized by that the delay portions 112S1 to 112Sn are separated from the sound-directing devices 116L1 to 116L12 and 116R1 to 116R12. Such configuration of the second embodiment is advantageous in that the multipliers, which are included in the sound-directing devices conventionally used in the sound localization control apparatus, can be removed; and consequently, the system configuration of the apparatus as a whole can be simplified.

In addition, tile delay times DTL and DTR which are respectively applied to the left-channel component and right-channel component of the acoustic data in each of the delay portions 112S1 to 112Sn are respectively computed in response to the distances DL and DR with respect to the target sound-image location. These delay times are effective to accurately perform the delay operations on the acoustic data. In short, it is possible to accurately localize the sounds at the target sound-image location.

Further, each of the sound-directing devices 116L1 to 116L12 and 116R1 to 116R12 uses a pair of coefficients which are fixed at certain values. For this reason, the second embodiment does not require the super-high-speed processor. In short, it is possible to configure the apparatus with simple and inexpensive circuits.

The aforementioned second embodiment uses twelve pairs of the sound-directing devices with respect to twelve horizontal directions. However, the number of the sound-directing devices provided in the apparatus is not limited to twelve. In other words, the number of the sound-directing devices can be determined with respect to at least three directions in the space.

In order to produce the sounds corresponding to the acoustic data, the second embodiment employs the speakers so that the cross-talk canceller 118 is required. However, if the listener uses the headphone set to listen to the sounds, the cross-talk canceller 118 is not required.

Operations of each delay portion and each sound-directing device can be embodied by use of the digital signal processor (i.e., DSP) in which micro programs are built in.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A sound localization control apparatus comprising:

a plurality of sound directing means, each for localizing a sound corresponding to acoustic data applied thereto in each of predetermined sounding directions;

a designating means for producing a direction parameter and a distance parameter in connection with a target sound-image location at which the sounds are localized, said direction parameter designating a direction from a listener who listens to the sounds to said target sound-image location, while said distance parameter designates a distance between the listener and said target sound-image location; and an allocating means for selecting at least one of said plurality of sound-directing means in response to the direction designated by said designating means, so that said allocating means allocates said acoustic data to said at least one sound-directing means selected, while said allocating means also allocates said acoustic data to one or some of said plurality of sound-directing means, other than said at least one sound-directing means selected, in response to the distance designated by said designating means, wherein outputs of said plurality of sound-directing means are mixed together to reproduce the sounds corresponding to said acoustic data which are localized in accordance with said target sound-image location.

2. A sound localization control apparatus comprising:

a filter means for performing a predetermined filtering operation on acoustic data applied thereto to attenuate eliminate a predetermined frequency-band component in said acoustic data;

a plurality of sound-directing means, each for imparting a predetermined sounding direction which is arranged in a horizontal plane with respect to a listener who listens to sounds corresponding to said acoustic data, each of said plurality of sound-directing means having a function to localize the sounds in each of the predetermined sounding directions;

a designating means for producing a direction parameter and a distance parameter in connection with a target sound-image location at which the sounds are localized, said direction parameter designating a direction from the listener to said target sound-image location, while said distance parameter designates a distance between the listener and said target sound-image location;

a dividing means for dividing output data of said filter means into first data and second data in response to the distance designated by said designating means;

a first allocating means for allocating said first data to said plurality of sound-directing means in accordance with a first allocation ratio which is determined in response to the direction designated by said designating means; and a second allocating means for allocating said second data to said plurality of sound-directing means in accordance with a second allocation ratio which is determined in response to the direction designated by said designating means, wherein outputs of said plurality of sound-directing means are mixed together to reproduce the sound corresponding to said acoustic data which are localized in accordance with said target sound-image location.

3. A sound localization control apparatus as defined in claim 2, wherein each of said plurality of sound-directing means is configured by a finite-impulse response filter.

4. A sound localization control apparatus as defined in claim 2, wherein said filter means is configured by a notch filter.

5. A sound localization control apparatus comprising:

a designating means for producing a first delay time, a second delay time, a horizontal-direction parameter and a vertical-direction parameter on the basis of a distance and a direction from a listener who listens to a sound corresponding to acoustic data and a target sound-image location at which the sounds are localized;

a filter means for performing a predetermined filtering operation on said acoustic data in response to said vertical-direction parameter to attenuate a predetermined frequency-band component in said acoustic data;

a delay means for producing first data and second data on the basis of output data of said filter means, said delay means delaying said first data by said first delay time, while said delay means also delays said second data by said second delay time;

a plurality of first sound-directing means and second sound-directing means, each pair of said first sound-directing means and said second sound-directing means being applied with each of predetermined sounding directions which are arranged in a horizontal plane with respect to the listener, each of said plurality of first sound-directing means having a function to localize the sound in each of the predetermined sounding directions in connection with a left ear of the listener, while each of said plurality of second sound-directing means has a function to localize the sound in each of the predetermined sounding directions in connection with a right ear of the listener;

a first allocating means for allocating said first data delayed to said plurality of first sound-directing means in accordance with a first allocation ratio which is determined in response to the horizontal-direction parameter; and a second allocating means for allocating said second data delayed to said plurality of second sound-directing means in accordance with a second allocation ratio which is determined in response to the horizontal-direction parameter, wherein outputs of said plurality of first sound-directing means are mixed together with outputs of said plurality of second sound-directing means to reproduce stereophonic sounds corresponding to said acoustic data which are localized in accordance with said target sound-image location.

6. A sound localization control apparatus as defined in claim 5, wherein said filter means is configured by a notch filter.

7. A sound localization control apparatus as defined in claim 5, wherein each of said plurality of first sound-directing means and second sound-directing means is configured by a finite-impulse response filter.

8. A sound localization control apparatus comprising:

sound-image location designating means for designating a direction of a sound-image location from a listener and a distance between said sound-image location and the listener in order to localize a sound corresponding to an acoustic signal;

first binaural signal producing means for imparting a first transfer characteristic to the acoustic signal supplied thereto in response to the direction designated by said sound-image location designating means to produce a first binaural signal, said first binaural signal being formed by two-channel stereophonic signals;

a second binaural signal producing means for imparting a second transfer characteristic to the acoustic signal supplied thereto in response to the direction designated by said sound-image location designating means to produce a second binaural signal, said second binaural signal being formed by two-channel stereophonic signals, said second transfer characteristic being determined such that the listener will feel as if said sound-image location is made unclear as compared to said first transfer characteristic;

allocating means for allocating the acoustic signal to said first and second binaural signal producing means in response to the distance designated by said sound-image location designating means, wherein an allocation ratio is controlled such that as the distance becomes longer, the allocation ratio to said second binaural signal producing means becomes larger; and adding means for adding said first and second binaural signals together with respect to each of two channels so as to produce a third binaural signal.

9. A sound localization control apparatus as defined in claim 1, wherein each of said plurality of sound-directing means is configured by a finite-impulse response filter.

10. A sound localization control device for localizing sounds for a listener, the device comprising:

a plurality of sound directing circuits that each localize a sound corresponding to acoustic data applied thereto in each of a plurality of predetermined sounding directions;

a designating circuit that produces a direction parameter and a distance parameter in connection with a target sound-image location at which the sounds are localized, the direction parameter designating a direction from the listener who listens to the sounds to the target sound-image location, and the distance parameter designating a distance between the listener and the target sound-image location;

an allocating circuit that selects at least one of the plurality of sound-directing means in response to the direction parameter designated by the designating circuit, so that said allocating circuit allocates the acoustic data to the at least one selected sound-directing circuit, while the allocating circuit also allocates the acoustic data to one or some of the plurality of sound-directing circuits, other than the at least one selected sound-directing circuit, in response to the distance parameter designated by the designating circuit; and a mixing circuit which mixes outputs of the plurality of sound-directing circuits together to reproduce the sounds corresponding to the acoustic data which are localized in accordance with the target sound-image location.

11. A device according to claim 10, wherein each of the plurality of sound-directing circuits includes a finite-impulse response filter.

12. A sound localization control device for localizing sound for a listener, the device comprising:

a filter circuit that performs a predetermined filtering operation on acoustic data applied thereto to attenuate a predetermined frequency-band component in the acoustic data;

a plurality of sound-directing circuits that each impart a predetermined sounding direction which is arranged in a horizontal plane with respect to the listener who listens to sounds corresponding to the acoustic data, each of the plurality of sound-directing circuits having a function to localize the sounds in each of the predetermined sounding directions;

a designating circuit that produces a direction parameter and a distance parameter in connection with a target sound-image location at which the sounds are localized, the direction parameter designating a direction from the listener to the target sound-image location, and the distance parameter designating a distance between the listener and the target sound-image location;

a dividing circuit that divides output data from the filter circuit into first data and second data in response to the distance designated by the designating circuit;

a first allocating circuit that allocates the first data to the plurality of sound-directing circuits in accordance with a first allocation ratio which is determined in response to the direction parameter designated by the designating circuit;

a second allocating circuit that allocates the second data to the plurality of sound-directing circuits in accordance with a second allocation ratio which is determined in response to the direction parameter designated by the designating circuit; and a mixing circuit which mixes outputs of the plurality of sound-directing circuits together to reproduce the sound corresponding to the acoustic data which are localized in accordance with the target sound-image location.

13. A device according to 12, wherein each of the plurality of sound-directing circuits includes a finite-impulse response filter.

14. A device according to claim 12, wherein the filter circuit includes a notch filter.

15. A sound localization control device for localizing sound for a listener having a left ear and a right ear, the device comprising:

a designating circuit that produces a first delay time, a second delay time, a horizontal-direction parameter and a vertical-direction parameter on the basis of a distance and a direction from the listener who listens to a sound corresponding to acoustic data and a target sound-image location at which the sounds are localized;

a filter circuit that performs a predetermined filtering operation on the acoustic data to produce filtered output data in response to the vertical-direction parameter to attenuate a predetermined frequency-band component in the acoustic data;

a delay circuit that produces first data and second data on the basis of the filtered output data from the filter circuit, the delay circuit delaying the first data by the first delay time, and the delay circuit delaying the second data by the second delay time;

a plurality of first sound-directing circuits and second sound-directing circuits, each pair of the first sound-directing circuits and the second sound-directing circuits being applied with each of predetermined sounding directions which are arranged in a horizontal plane with respect to the listener, each of the plurality of first sound-directing circuits having a function to localize the sound in each of the predetermined sounding directions in connection with the left ear of the listener, and each of the plurality of second sound-directing circuits having a function to localize the sound in each of the predetermined sounding directions in connection with the right ear of the listener;

a first allocating circuit that allocates the first data delayed to the plurality of first sound-directing circuits in accordance with a first allocation ratio which is determined in response to the horizontal-direction parameter;

a second allocating circuit that allocates the second data delayed to the plurality of second sound-directing circuit in accordance with a second allocation ratio which is determined in response to the horizontal-direction parameter; and a mixing circuit which mixes outputs of the plurality of first sound-directing circuits together with outputs of the plurality of second sound-directing circuits to reproduce stereophonic sounds corresponding to the acoustic data which are localized in accordance with the target sound-image location.

16. A device according to claim 15, wherein said filter circuit includes a notch filter.

17. A device according to claim 15, wherein each of the plurality of first sound-directing circuits and second sound-directing circuits includes a finite-impulse response filter.

18. A sound localization control device for localizing sound for a listener, the device comprising:

a sound-image location designating circuit that designates a direction of a sound-image location from the listener and a distance between the sound-image location and the listener in order to localize a sound corresponding to an acoustic signal;

a first binaural signal producing circuit that imparts a first transfer characteristic to the acoustic signal supplied thereto in response to the direction designated by the sound-image location designating circuit so as to produce a first binaural signal, the first binaural signal being formed by stereophonic signals;

a second binaural signal producing circuit that imparts a second transfer characteristic to the acoustic signal supplied thereto in response to the direction designated by the sound-image location designating circuit so as to produce a second binaural signal, the second binaural signal being formed by stereophonic signals, the second transfer characteristic being determined such that the listener will feel as if the sound-image location is made unclear as compared to the first transfer characteristic;

an allocating circuit that allocates the acoustic signal to the first and second binaural signal producing circuits in response to the distance designated by the sound-image location designating circuit, wherein an allocation ratio is controlled such that as the distance becomes longer, the allocation ratio to the second binaural signal producing circuit becomes larger; and a mixing circuit which mixes the first and second binaural signals together to produce a third binaural signal.

19. A method of localizing sound for a listener, the method comprising the steps of:

localizing a sound corresponding to acoustic data applied thereto in each of a plurality of predetermined sounding directions with a corresponding plurality of sound-directing circuits;

producing a direction parameter and a distance parameter in connection with a target sound-image location at which the sounds are localized, the direction parameter designating a direction from the listener who listens to the sounds to the target sound-image location, and the distance parameter designating a distance between the listener and the target sound-image location;

selecting at least one of the plurality of sound-directing circuits in response to the direction parameter;

allocating the acoustic data to the sound directing circuit in at least one selected sound-directing circuits, while allocating the acoustic data to one or some of the plurality of sound-directing circuits for the plurality of sound directions, other than the at least one selected sound-directing circuit, in response to the distance parameter; and mixing together the acoustic data allocated to the plurality of sound-directing circuits to reproduce the sounds corresponding to the acoustic data which are localized in accordance with the target sound-image location.

20. A method of localizing sound for a listener, the method comprising the steps of:

performing a predetermined filtering operation on acoustic data applied thereto to attenuate a predetermined frequency-band component in the acoustic data to produced filtered output data;

imparting a predetermined sounding direction with a plurality of sound-directing circuits corresponding to a plurality of sounding directions which are arranged in a horizontal plane with respect to the listener who listens to sounds corresponding to said acoustic data, each of the plurality of sound-directing circuits having a function to localize the sounds in each of the predetermined sounding directions;

producing a direction parameter and a distance parameter in connection with a target sound-image location at which the sounds are localized, the direction parameter designating a direction from the listener to the target sound-image location, and the distance parameter designating a distance between the listener and the target sound-image location;

dividing the filtered output data into first data and second data in response to the distance parameter;

allocating the first data to the plurality of sound-directing circuits in accordance with a first allocation ratio which is determined in response to the direction parameter;

allocating the second data to the plurality of sound-directing circuits in accordance with a second allocation ratio which is determined in response to the direction parameter; and mixing together outputs of the plurality of sound-directing circuits to reproduce the sounds corresponding to the acoustic data which are localized in accordance with said target sound-image location.

21. A method of localizing sound for a listener having a left ear and a right ear, the method comprising the steps of:

producing a first delay time, a second delay time, a horizontal-direction parameter and a vertical-direction parameter on the basis of a distance and a direction from the listener who listens to sounds corresponding to acoustic data and a target sound-image location at which the sounds are localized;

performing a predetermined filtering operation on the acoustic data in response to the vertical-direction parameter to attenuate a predetermined frequency-band component from said acoustic data to produce filtered output data;

producing first data and second data on the basis of the filtered output data;

delaying the first data by the first delay time;

delaying the second data by the second delay time;

selecting a plurality of first sound-directing circuits and second sound-directing circuits in a plurality of predetermined sounding directions that are each arranged in a horizontal plane with respect to the listener, each of the plurality of first sound-directing circuits having a function to localize the sound in each of the predetermined sounding directions in connection with the left ear of the listener, while each of the plurality of second sound-directing circuits has a function to localize the sound in each of the predetermined sounding directions in connection with the right ear of the listener;

allocating the delayed first data to the plurality of first sound-directing circuits in accordance with a first allocation ratio which is determined in response to the horizontal-direction parameter;

allocating the delayed second data to the plurality of second sound-directing circuits in accordance with a second allocation ratio which is determined in response to the horizontal-direction parameter; and mixing together outputs of the plurality of first sound-directing circuits with outputs of the plurality of second sound-directing circuits to reproduce stereophonic sounds corresponding to the acoustic data which are localized in accordance with said target sound-image location.

22. A method of localizing sound for a listener, the method comprising the steps of:

designating a direction of a sound-image location from the listener and a distance between the sound-image location and the listener in order to localize a sound corresponding to an acoustic signal;

imparting a first transfer characteristic to the acoustic signal supplied thereto with a first binaural circuit in response to the direction designated by the sound-image location to produce a first binaural signal, the first binaural signal being formed by stereophonic signals;

imparting a second transfer characteristic to the acoustic signal supplied thereto with a second binaural circuit in response to the direction designated by the sound-image location to produce a second binaural signal, the second binaural signal being formed by stereophonic signals, wherein the second transfer characteristic is determined such that the listener will feel as if the sound-image location is made unclear as compared to the first transfer characteristic;

allocating the acoustic signal to the first and second binaural circuits in response to the distance between the listener and the sound-image location, wherein an allocation ratio is controlled such that as the distance becomes longer, the allocation ratio to the second binaural circuit becomes larger; and adding the first and second binaural signals together to produce a third binaural signal.

* * * * *